US006293065B1

(12) United States Patent
Suzuki et al.

(10) Patent No.: US 6,293,065 B1
(45) Date of Patent: Sep. 25, 2001

(54) HIGH STRENGTH POROUS CONCRETE STRUCTURE AND METHOD OF MANUFACTURING THE HIGH STRENGTH POROUS CONCRETE STRUCTURE

(75) Inventors: Hiroaki Suzuki, Tokyo; Kikuo Tachibana, Osaka; Tatsuji Tanahashi, Osaka; Tetsuo Kobayashi, Osaka, all of (JP)

(73) Assignee: Sumitomo Osaka Cement Co., Ltd., Tokyo (JP)

( * ) Notice: Subject to any disclaimer, the term of this patent is extended or adjusted under 35 U.S.C. 154(b) by 0 days.

(21) Appl. No.: 09/232,735

(22) Filed: Jan. 19, 1999

(30) Foreign Application Priority Data

Feb. 16, 1998 (JP) ..... 10-033328
Aug. 7, 1998 (JP) ..... 10-224997

(51) Int. Cl.[7] ..... E04C 5/00

(52) U.S. Cl. ..... 52/315; 52/596; 52/309.17; 52/311.1; 52/747.12; 428/143

(58) Field of Search ..... 52/309.13, 309.14, 52/DIG. 7, 315, 311.1, 596, 612, 747.12; 428/304.4, 150, 141, 143

(56) References Cited

U.S. PATENT DOCUMENTS 5,215,406 * 6/1993 Hudson ..... 405/25
5,380,549 * 1/1995 Harvison ..... 427/137
5,410,850 * 5/1995 Dreizler ..... 52/309.17
5,535,563 * 7/1996 Brown et al. ..... 52/235
5,612,116 * 3/1997 Jinno et al. ..... 428/143
5,766,728 * 6/1998 Iwaya ..... 428/143

* cited by examiner

*Primary Examiner*—Christopher T. Kent
(74) *Attorney, Agent, or Firm*—Banner & Witcoff, Ltd.

(57) ABSTRACT

This invention is intended to provide a high strength porous concrete structure which is preferably applied to a water permeable pavement, a draining pavement, a sound insulating board, a sound-proofing barrier, a sound absorbing block for acoustic, a block for plants, a riverbed block, a water purifying matrix, a gas absorbing matrix, a decorative board for building, a fish reef, a block for fish reef or a block for breeding algae and to provide a method of manufacturing the high strength porous concrete structure.

The high strength porous concrete structure 1 having an arrangement in which a plurality of lumps 2 whose configuration is rough aggregates are integrally formed with the same concrete tissue and a gap 3 formed between the lumps 2 is through to a back side 2*a* of the lump 2 is manufactured by putting a thermoplastic material 8 into contact with a surface of a porous concrete structure 6 using rough aggregates 10 so as to form a form 9 and placing mortar or concrete 13 which does not include rough aggregates into the form 9.

12 Claims, 22 Drawing Sheets

HIGH STRENGTH POROUS CONCRETE STRUCTURE AND METHOD OF MANUFACTURING THE HIGH STRENGTH POROUS CONCRETE STRUCTURE

FIELD OF THE INVENTION

This invention relates to a high strength porous concrete structure which is applied to a water permeable pavement, a draining pavement, a sound insulating board, a sound-proofing barrier, a sound absorbing block for acoustic, a block for plants, a riverbed block, a water purifying matrix, a gas absorbing matrix, a decorative board for building, a fish reef, a block for fish reef or a block for breeding algae and to a method of manufacturing the high strength porous concrete structure.

BACKGROUND OF THE INVENTION

Porous concrete structures are conventionally, for example, made of cement, rough aggregates and water, and each of which is kneaded and cured to be used for water permeable pavements or draining pavements.

However, the porous concrete structures have such an arrangement in which each of the rough aggregates is connected with cement paste and kept in contact at a point. As a result, the porous concrete structures are low in both flexural strength and compressive strength and also it is difficult to increase resistance to fly loss. In other words, for a pavement made of the porous concrete structure having the above arrangement it easily causes fly loss of rough aggregates locating on the surface thereof when a big stress is applied to the surface thereof every time vehicles frequently brake.

Further since the porous concrete structures have a porous arrangement, resistance to a freeze-thaw effect is very low. Therefore, it is not recommendable to use the porous concrete structures in a cold district.

SUMMARY OF THE INVENTION

In order to solve the above-mentioned problems, the invention is intended to provide a high strength porous concrete structure having an arrangement of porous as a whole or having an arrangement in which a surface portion alone is porous by forming a plurality of lumps which are exposed to the surface of the structure and whose configuration corresponds to a configuration of an original material to be transferred such as rough aggregates and each of which is integrally made of the same concrete tissue with a gap formed between the lumps which is through to a back side of the lumps.

The invention is also intended to provide a method of manufacturing the high strength porous concrete structure having the above-mentioned arrangement with ease which comprises the steps of transferring a surface configuration of an object exposing an original material to be transferred such as a porous concrete structure using rough aggregates into an elastically deformable form made of a thermoplastic material and placing mortar or concrete into the form.

The high strength porous concrete structure 1 in accordance with the invention is, as shown in FIGS. 1 and 2, that a plurality of lumps 2 whose configuration conforms to a configuration of rough aggregates as an original material to be transferred are interconnected and exposed to a surface 1*a* of the high strength porous concrete structure 1 and a gap 3 formed between the lumps 2 is through to a back side 2*b* of the lumps 2, and is characterized by that the lumps 2 are integrally made of the same concrete tissue 4.

In accordance with the arrangement, at least a surface portion 1A of the high strength porous concrete structure 1 becomes porous because of its stereostructure formed by a plurality of lumps 2 whose configuration conform to the original material to be transferred and the gap 3 which is through to the back side 2*b* of the lumps 2. As a result of this, if the high strength porous concrete structure 1 is used, for example, as a pavement, the surface portion 1A produces an effect of water permeability and if the high strength porous concrete structure 1 is used as a wall or a block for acoustic, the surface portion 1A produces an effect of sound-absorbing. In addition, if the the high strength porous concrete structure 1 is used as a block for plants or a riverbed block, the gap 3 formed between the lumps 2 works as a space to keep a plant seed, soil or a fertilizer. Further if the high strength porous concrete structure 1 is used as a water purifying matrix or a gas absorbing matrix, the gap 3 works as a space to breed algae for water purification or a space to keep a catalyst for gas absorption. From the viewpoint of its appearance, the high strength porous concrete structure 1 can also be used as a decorative board for building because its appearance closely resembles that of a conventional porous concrete structure 6 which is made of cement, rough aggregates 10 and water, and each of which is kneaded and cured as shown in FIG. 10.

Unlike the conventional porous concrete structure 6, the high strength porous concrete structure 1 has such an arrangement in which each of the lumps 2 is made of the same concrete tissue 4 and the lumps 2 being exposed to the surface 1*a* are integrally formed. As a result of this, a bond strength between the lumps 2 on the surface of the high strength porous concrete structure 1 is very high beyond comparison with that of the conventional porous concrete structure 6 where each of the rough aggregates 10 is connected with a thin cement paste layer 11 and kept in contact at a point. Therefore the high strength porous concrete structure 1 shows a far higher reading in both flexural strength and compressive strength than that of the conventional porous concrete structure 6. Fly loss also can easily be improved when it is used as a pavement.

In addition, if a conventional porous concrete structure is used as a draining pavement or a sound insulating board, it has to be made two-layered, thereby to complicate a manufacturing process. More particularly, in case used as the draining pavement, porous concrete tissue comprising rough aggregates and cement paste should be provided in order to form a water permeable layer on a surface side of the pavement and an ordinal concrete tissue comprising rough aggregates, fine aggregates and cement paste should be provided under the porous concrete tissue in order to form a solid tight layer which does not permeate water. Similarly, in case used as the sound insulating board, a porous concrete tissue comprising rough aggregates and cement paste should be provided in order to form a layer having a sound absorbing function on a surface side of the sound insulating board and an ordinal concrete tissue comprising rough aggregates, fine aggregates and cement paste should be provided back of the porous concrete tissue in order to form a solid tight layer which insulates sound. As mentioned above, it is inevitable to place concrete material of different combination at least twice in order to form a two-layered structure comprising a porous concrete layer made of rough aggregates and cement paste and an ordinal solid concrete layer. This causes a problem of increasing a number of processing steps and of lacking integrity because of two-layered structure.

In order to solve the above problems the high strength porous concrete structure 1 of the invention has an arrangement wherein the lumps 2 whose configuration conforms to rough aggregates as an original material to be transferred are made of the same concrete tissue 4. As a result, in case that a solid tight backing portion 1B is to be formed back of the porous surface portion 1A, the backing portion 1B can be continuously and integrally formed with the lumps 2 of the same concrete tissue 4 as shown in FIGS. 1 and 2. Then there is no need to place a porous concrete material comprising rough aggregates and cement paste for a surface portion and an ordinary concrete material for a backing portion separately, which makes it possible to form the porous surface portion 1A and the solid backing portion 1B simultaneously with a single process of placing concrete.

In one form of the embodiment, the lump 2, as shown in FIG. 3 where a magnified cross section of a part of the lump 2 is shown, may have an arrangement where a plurality of continuous air bubbles 5 are entrained in concrete tissue 4 of the lump 2. In accordance with the arrangement, if the structure is used as a sound absorbing board, the effect of sound absorbing can be much improved. In addition the weight of the structure can also be made lighter, thereby to make transportation or construction easy. Further, if used as a water purifying matrix, the structure can provide algae or microbes with a much larger residential area by means of the continuous air bubbles 5 a part 5*a* of which is open to the surface of the structure, thereby to improve the effect of water purification.

As explained above, in order to manufacture the high strength porous concrete structure inside of which a plurality of air bubbles are included, it is preferable to mix a foaming agent into concrete or mortar in order to entrain a plurality of air bubbles into the concrete or mortar. The foaming agent may concretely be represented by, for example, metal aluminum powder, synthetic surface-active agent system, a resin soap system or a hydrolytic protein system.

A method of manufacturing the high strength porous concrete structure can be represented by a method comprising the steps of putting a heated-to-melt thermoplastic material which cures at a normal temperature so as to be an elastically deformable form into contact with a surface of an object exposing an original material to be transferred such as a porous concrete structure using rough aggregates, curing the thermoplastic material so as to make the form, detaching the form from the object by making use of the elastic deformation of the form, placing an ordinal concrete material into the form and curing the concrete so as to obtain the above-mentioned high strength porous concrete structure. In this case resin mortar or resin concrete whose binder is polyester or epoxy resin may be used in stead of the ordinal concrete material. In accordance with the arrangement, the strength of the structure can be further improved.

The method will now concretely be described with reference to drawings. As shown in FIG. 4, place a porous concrete structure 6 as a conventional structure which contains rough aggregates 10 as an original material to be transferred in the center of a container 7 which is rectangle in a top plan view and then place a heated-to-melt thermoplastic material 8 into the container 7 from upward.

In this case, the thermoplastic material 8 is, for example, "EM" (Trade Name; Manufactured by Sumitomo Osaka Cement Co., Ltd.). The "EM" is thermoplastic elastomerics where oil is confined in a three-dimensional mesh structure of special polymer, and which is rubber elastic at a normal temperature and liquid at a high temperature such as over 210° C.

As mentioned above, pour the heated-to-melt thermoplastic material 8 into the container 7 and leave it for a while at a normal temperature so as to cure the thermoplastic material 8 as shown in FIG. 5. Then a form 9 made of rubber elastics is formed. Next detach the form 9 from the porous concrete structure 6 by making use of elastic deformation of the form 9 as shown in FIG. 6. Since the thermoplastic material 8 which has been poured from the surface side of the porous concrete structure 6 goes into a gap 12 between a plurality of rough aggregates 10 which constitute the porous concrete structure 6, the thermoplastic material 8 is made into the form 9 having a concave portion 9*a* which corresponds to the configuration of the rough aggregate 10 and a soft projection 9*b* which corresponds to the configuration of the gap 12 as shown in FIGS. 6 and 7. Then place mortar or concrete 13 into the form 9 and cure it as shown in FIG. 8 so that the high strength porous concrete structure 1 of the invention shown in FIG. 9 is manufactured. The high strength porous concrete structure 1 can easily be detached from the form 9 by making use of elastic deformation of the form 9 which is rubber elastics.

Another embodiment of this invention especially as a structure used for water permeable or draining pavement may be represented by a high strength porous concrete structure 101, as shown in FIGS. 11 and 12, comprising a surface layer 101A and a backing layer 101B which is united with the surface layer 101A and which has water permeability wherein the surface layer 101A comprises, like the above-descried, a plurality of lumps 102 having a configuration of an original material to be transferred such as rough aggregates and each of which is interconnected and exposed to a surface 101Aa of the surface layer 101A and integrally formed by the same concrete tissue 104, and a gap 103 which is formed between the lumps 102 and which is through from the surface 101Aa of the surface layer 101A to a boundary X between the surface layer 101A and the backing layer 101B. In accordance with the arrangement, at least the surface layer 101A is porous because of stereostructure formed by the gap 103 between a plurality of lumps 102 so that the surface layer 101A has water permeability. In addition, since the backing layer 101B is water permeable and united with the surface layer 101A and the gap 103 is through to the boundary X between the surface layer 101A and the backing layer 101B, the high strength porous concrete structure 101 has water permeability as a whole when used as a pavement.

In this case if the backing layer 101B is made of porous concrete 161 using rough aggregates 110 as shown in FIG. 12, the backing layer 101B has water permeability. As a result, the high strength porous concrete structure 101 can produce an effect of water permeability. If the backing layer 101B is made of solid tight concrete tissue 241, 341 where a water through hole 242*a*, 342*a*, 342*b* is provided as shown in FIG. 20 or FIG. 21, the high strength porous concrete structure 201, 301 can produce an effect of water permeability or a draining function depending on the configuration of the water though hole 242*a*, 342*a*, 342*b*. In this case resin mortar or resin concrete whose binder is polyester or epoxy resin can also be used in stead of ordinal concrete material. If so, the strength of the high strength porous concrete structure will be further improved.

As described above, since the high strength porous concrete structure in accordance with the invention has a porous surface portion because of the arrangement in which a plurality of lumps whose surface configuration is similar to a configuration of an original material to be transferred such as rough aggregates.are arranged all over the thickness of the high strength porous concrete structure and each of which is interconnected and exposed to the surface of the high strength porous concrete and are made of the same concrete tissue and the gap formed between the lumps is through to a back side of the lumps, it produces an effect of water permeability when used as a pavement and it produces an effect of sound absorbing when used as a wall or a block for acoustic. In addition, it can produce a suitable effect if applied to a block for plants, a riverbed block, a water purifying matrix, a gas absorbing matrix or a decorative board for building.

Further, since each of the lumps is interconnected and made of the same concrete tissue, the bond strength of the lumps is very high when compared with that of the conventional structure and both of the readings of the flexural and compressive strength on the whole are also very high. The fly loss can be effectively improved if the high strength porous concrete structure is applied to pavements.

Since the high strength porous concrete structure has an arrangement in which the plurality of lumps corresponding to the original material to be transferred such as rough aggregates are made of the same concrete tissue, the backing layer portion can be integrally and continuously made of the same concrete tissue as that of the lumps when the solid tight backing layer portion is formed back side of the porous surface layer portion. As a result, there is no need of placing a porous concrete material comprising rough aggregates and cement past and an ordinal concrete material for the backing layer portion. The porous surface layer portion and the solid tight backing layer portion can be formed with one single process of placing concrete. The high strength porous concrete structure having the solid tight backing layer can produce a suitable effect of draining or sound proof when used as a draining pavement or a sound proof wall.

If a plurality of continuous air bubbles are entrained in concrete tissue as well as the above-described gap, the bubbles can increase the effect of sound absorbing when the high strength porous concrete structure is applied to sound absorbing boards. In addition, the weight of the structure can be made lighter, which makes transportation or construction easy. Further, if used as a water purifying matrix, the structure can provide algae or microbes with a much larger residential area by means of the continuous air bubbles a part of which is open to the surface of the structure, thereby to improve the effect of water purification.

In manufacturing the above-mentioned high strength porous concrete structure if a method of manufacturing the high strength porous concrete structure comprises the steps of putting a heated-to-melt thermoplastic material which cures so as to be an elastically deformable form at a normal temperature into contact with a surface of an object exposing an original material to be transferred such as a porous concrete structure using rough aggregates, curing the thermoplastic material so as to make the form, detaching the form from the object by making use of the elastic deformation of the form, placing mortar or concrete into the form and curing the mortar or concrete, the high strength porous concrete structure in accordance with claim 1 can be manufactured with ease and accuracy.

If a plurality of air bubbles are entrained into mortar or concrete by mixing foaming agent into the mortar or concrete, the high strength porous concrete structure in accordance with claim 5 can be manufactured with ease.

If the high strength porous concrete structure comprises a surface layer and a backing layer having an effect of water permeability or draining and which is united with the surface layer, wherein the surface layer has an arrangement in which a plurality of lumps whose configuration is that of rough aggregates as an original material to be transferred are interconnected and exposed to the surface of the surface layer and a gap formed between the lumps is through to a back side of the lumps and the lumps are integrally made of the same concrete tissue, at least the surface layer becomes porous because of its stereostructure formed by a plurality of lumps and is the gap between the lumps. Therefore, the high strength porous concrete structure can be used as a pavement which is especially superior in water permeability or draining effect.

In this case, if the backing layer is made of porous concrete using rough aggregates, the backing layer produces an effect of water permeability, thereby to give an effect of water permeability to the high strength porous concrete structure in accordance with the invention. If the backing layer is made of a solid tight concrete tissue with which a water through hole is provided, the backing layer produces an effect of water permeability or draining depending on a shape of the water through hole, thereby to give an effect of water permeability or draining to the high strength porous concrete structure in accordance with the invention.

In manufacturing the high strength porous concrete structure which can be used for water permeable of draining pavements a method comprises the steps of putting a heated-to-melt thermoplastic material which cures so as to be an elastically deformable form at a normal temperature into contact with a surface of an object exposing an original material to be transferred such as a porous concrete structure using rough aggregates, curing the thermoplastic material so as to make the form, detaching the form from the object by making use of the elastic deformation of the form, placing mortar or concrete into the form and curing the mortar or concrete so as to form the surface layer of the structure. The high strength porous concrete structure can also be manufactured by arranging the above-mentioned form in a base of a container, placing mortar or concrete in the form, curing the mortar or concrete so as to form a surface layer and then placing porous concrete having rough aggregates over the surface layer so as to form a backing layer.

In any case of the above, if resin mortar or resin concrete whose binder is polyester or epoxy resin is used in stead of mortar or concrete, the strength of the high strength porous concrete structure can be further improved.

DETAILED DESCRIPTION OF THE PREFERRED EMBODIMENTS

An embodiment of the invention will now be concretely described below.

Figure 1:
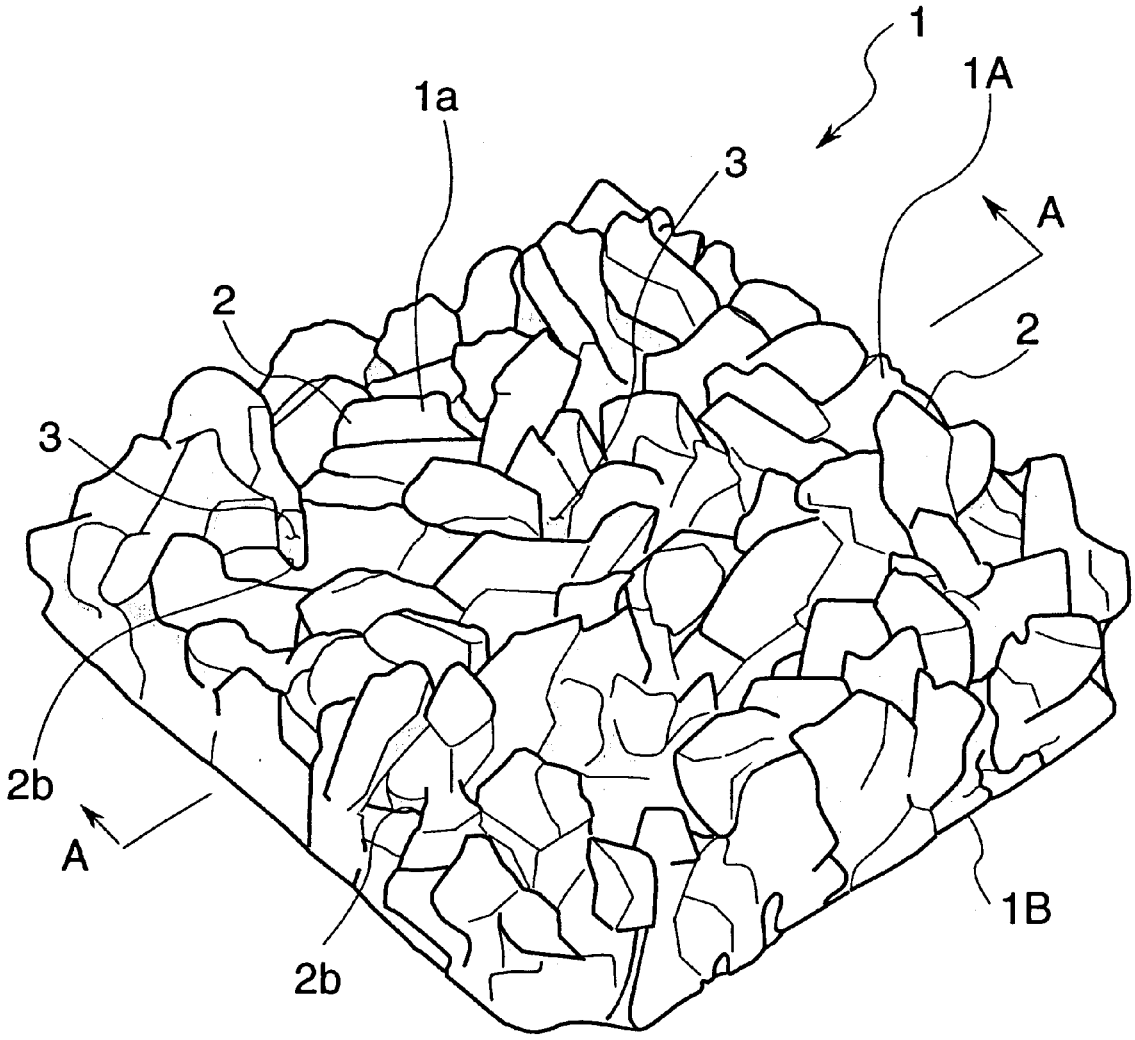
FIG. 1 is a referential perspective view showing a preferred embodiment of this invention.
Figure 2:
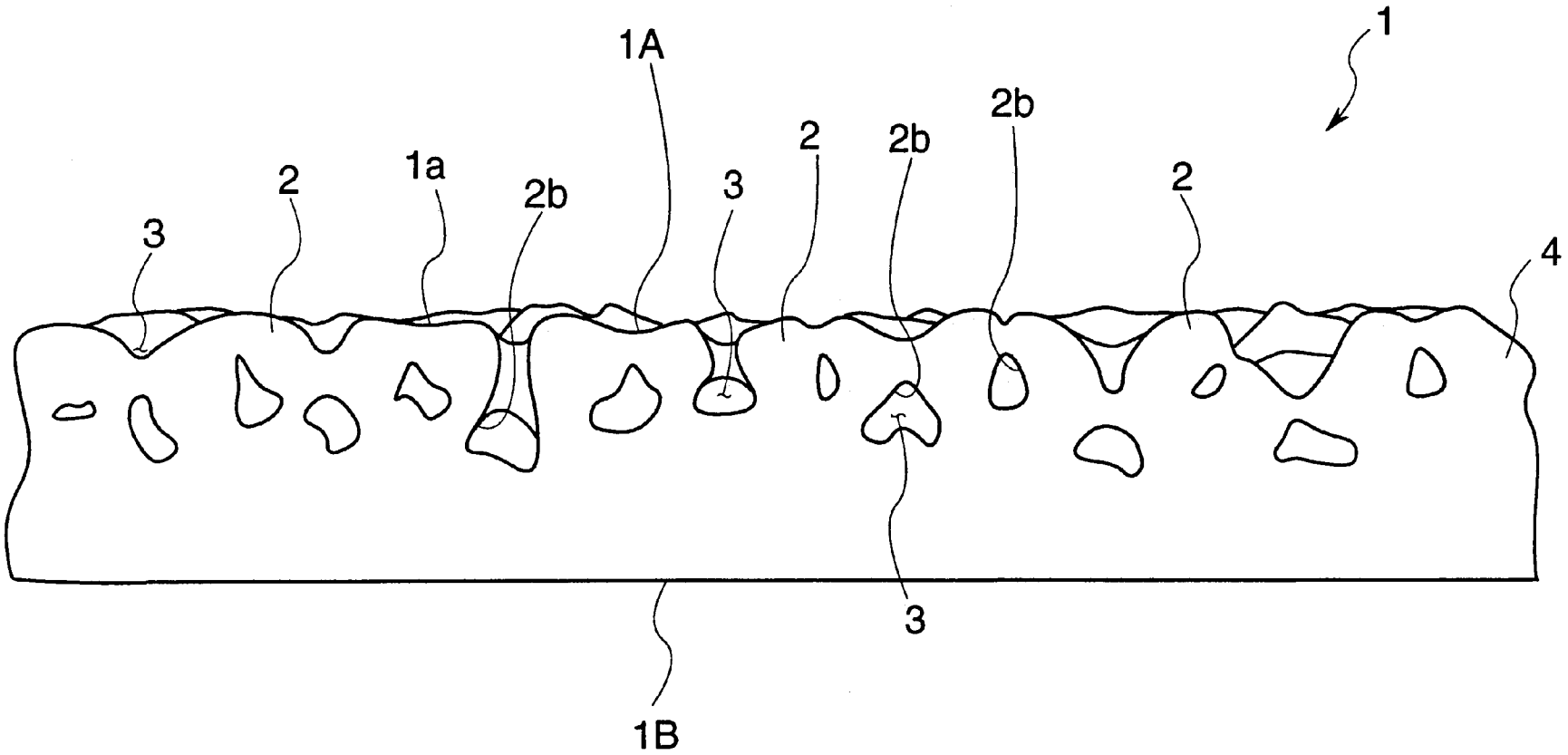
FIG. 2 is a cross sectional view of FIG. 1 taken along line A—A.
Figure 3:
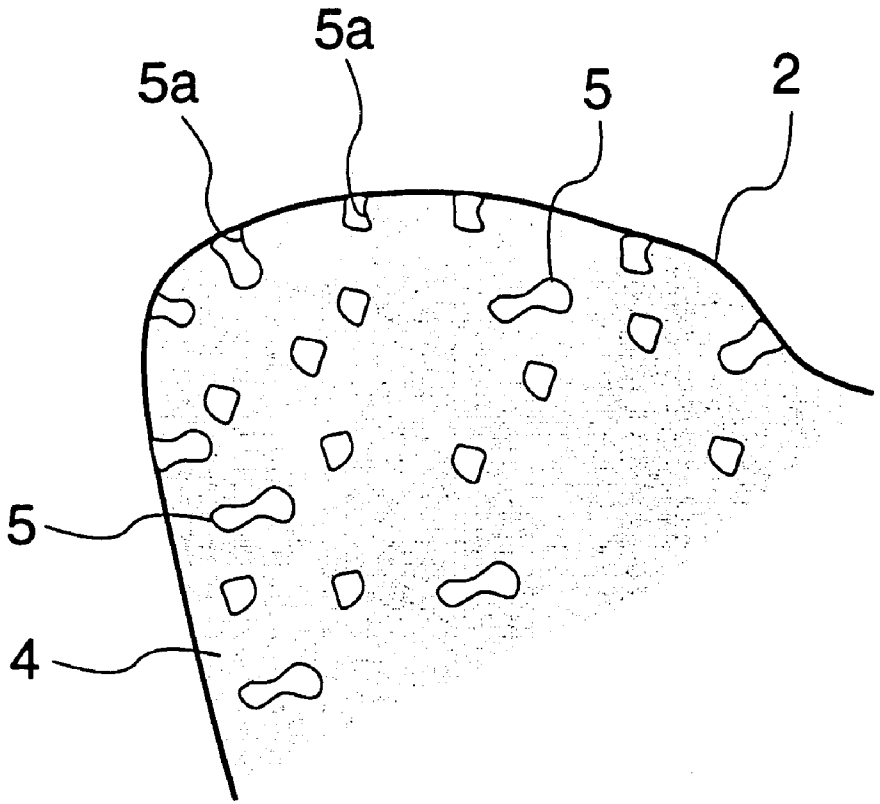
FIG. 3 is a magnified partial cross sectional view of a lump showing the preferred embodiment of the invention.
Figure 4:
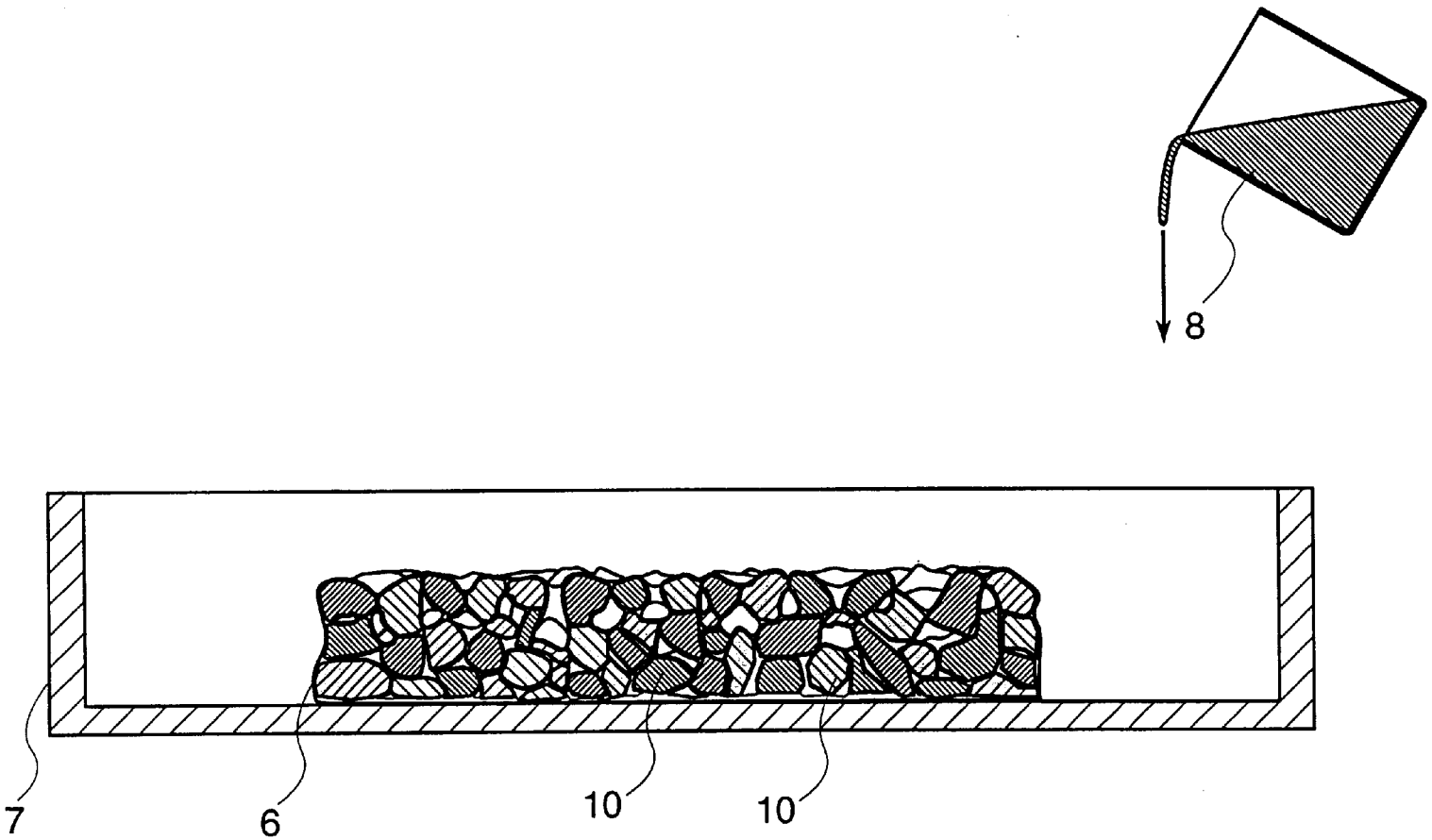
FIG. 4 is a view to explain a method of manufacturing the high strength porous concrete structure in accordance with the embodiment of the invention.
Figure 5:
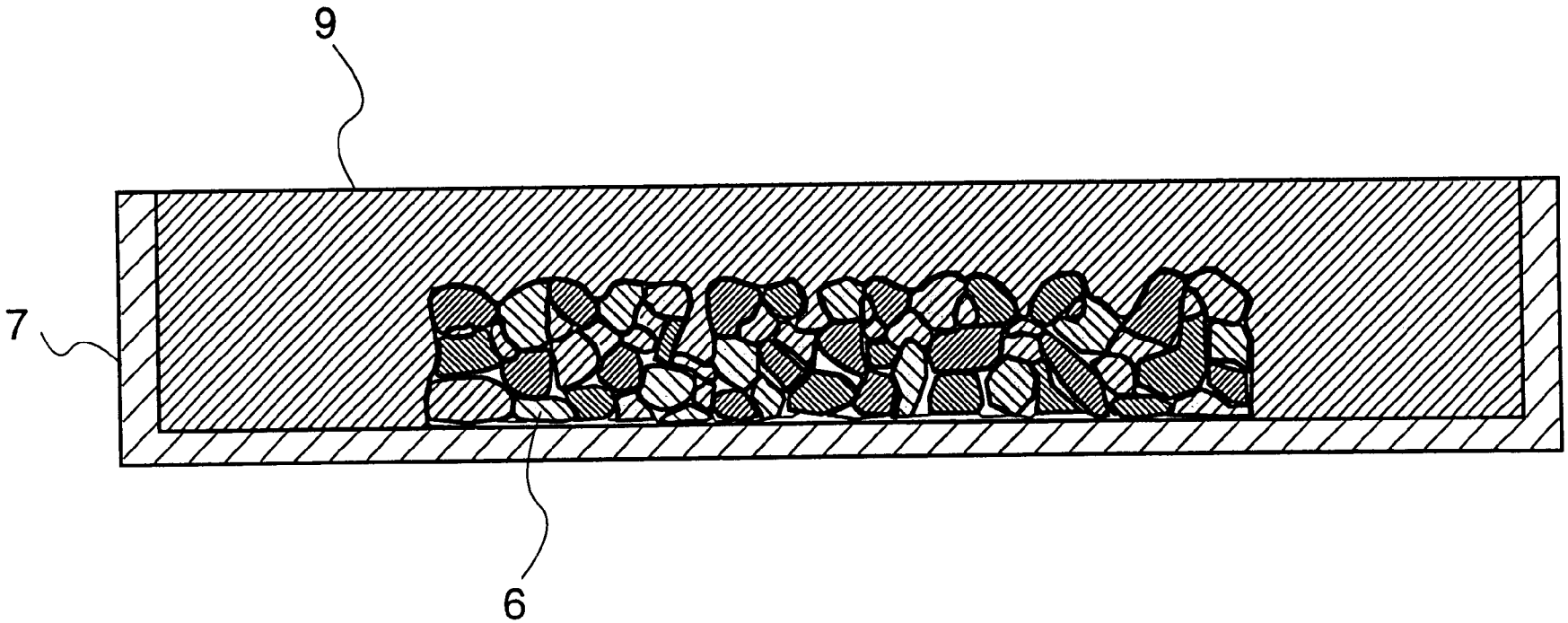
FIG. 5 is a view to explain the above-mentioned method.
Figure 6:
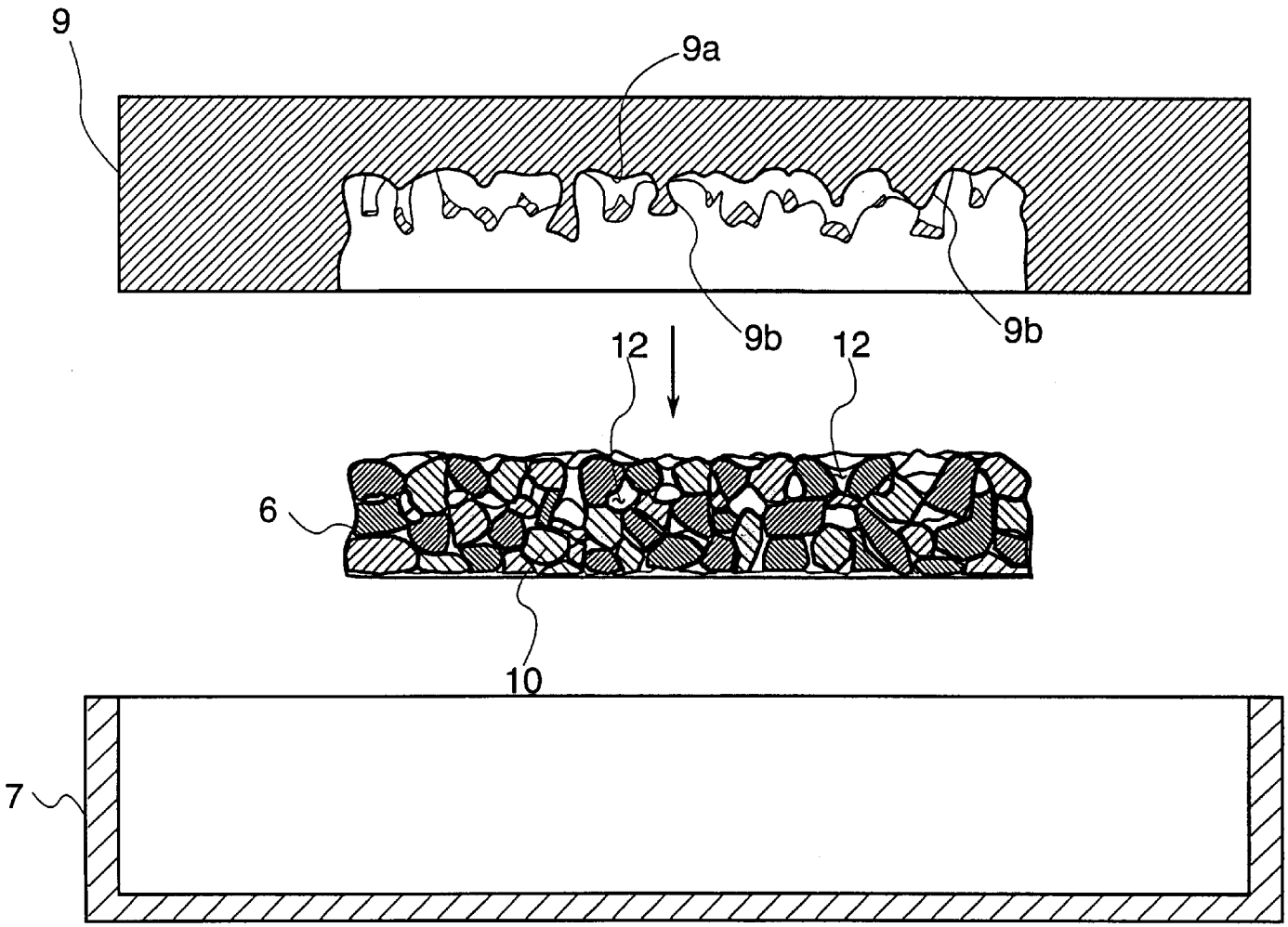
FIG. 6 is a view to explain the above-mentioned method.
Figure 7:
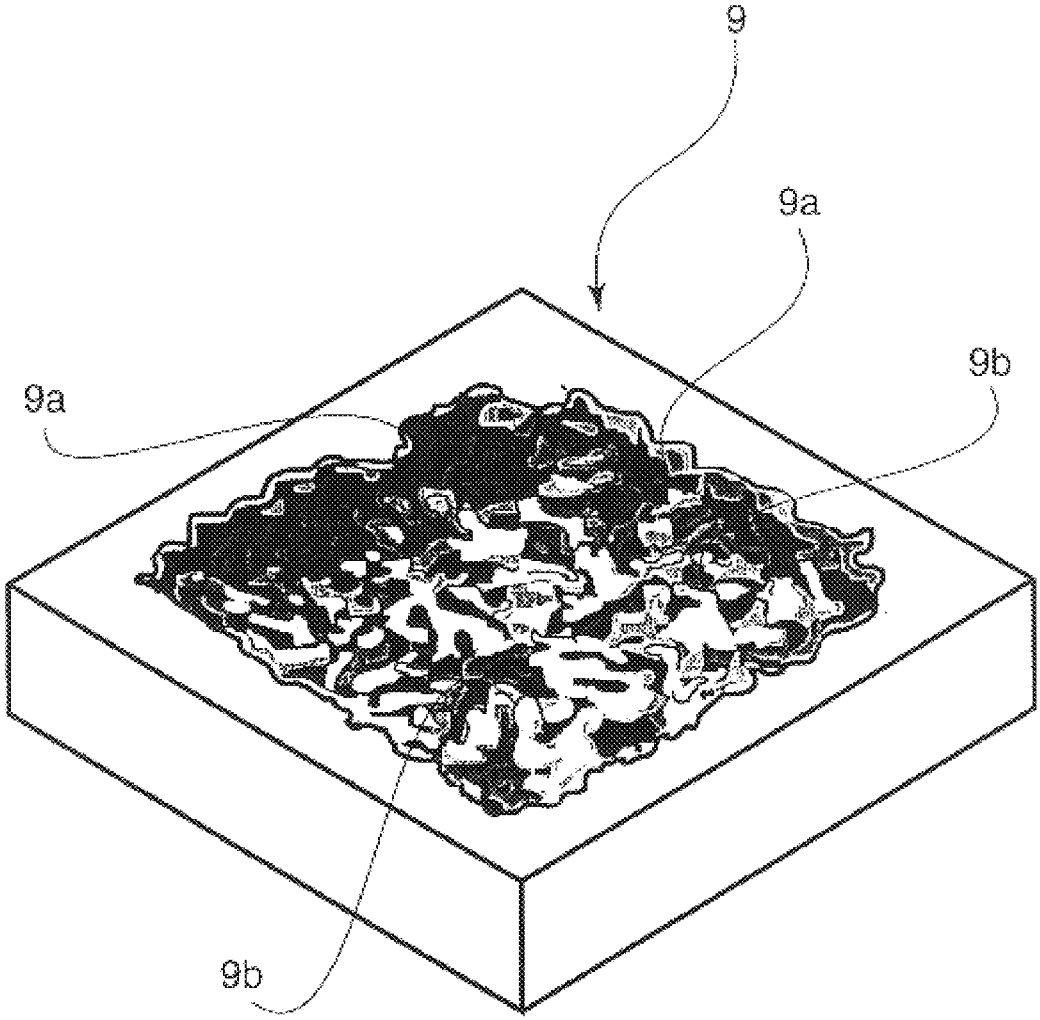
FIG. 7 is a referential perspective view showing a form used by the above-mentioned method.
Figure 8:
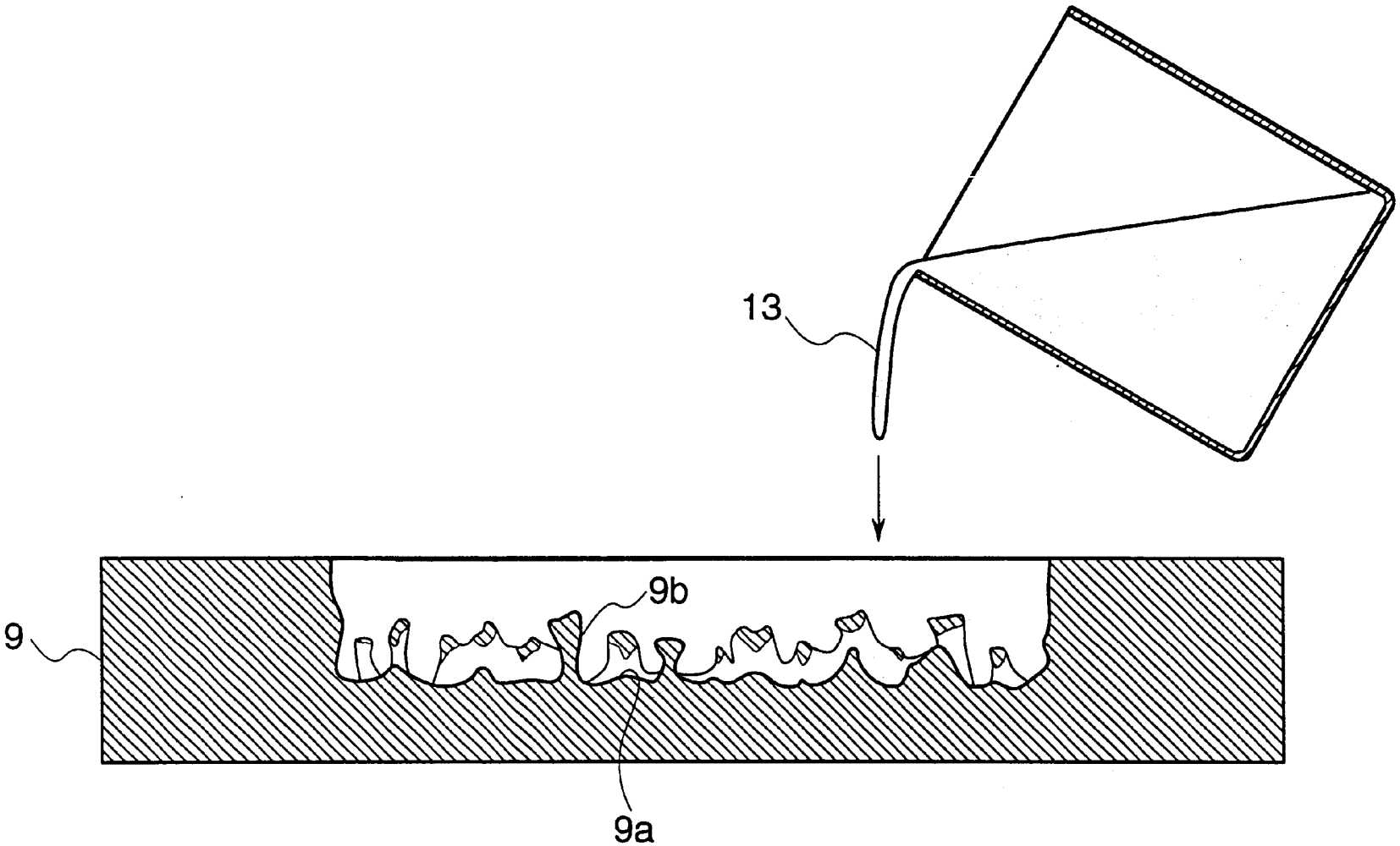
FIG. 8 is a view to explain the above-mentioned method.

First, manufacture a conventional porous concrete structure (examples 1, 2 and 3 for comparison) which is to be an original material to be transferred. Next, make a form shown in FIG. 7 by means of a procedure shown in FIG. 4 through FIG. 6 using the conventional porous concrete structure. Then place a concrete material having the following mixing rate into the form so as to obtain each of high strength porous concrete structures (embodiments 1, 2, 3 and 4) in accordance with the invention.

COMPARISON EXAMPLE 1

(a) Manufacture of a Porous Concrete Structure

Compound and knead rough aggregates having a diameter of 10 to 20 mm, Portland cement and water into concrete with the ratio of water to the Portland cement 28% and the ratio of the Portland cement to the rough aggregates 17% where the unit cement weight is 260 kg/m$^3$ and the unit rough aggregate weight is 1560 kg/m$^3$. Place the kneaded concrete into a predetermined form. Detach the concrete from the form after the concrete is cured so as to obtain a porous concrete structure. The porous concrete structure had a porous arrangement where each of the rough aggregates was connected with cement paste and kept in a contact at a point and voids thereof was 20 to 30%.

(b) Strength of the Porous Concrete Structure

The porous concrete in accordance with the comparison example 1 showed as follows: The compressive strength read 100 to 200 Kgf/cm$^2$, the flexural strength read 15 to 20 kgf/cm$^2$ and the fly loss read 20 to 40%. The fly loss shows a resistance of an aggregate to detaching or flying loss caused by means of a load of a tire and was measured in accordance with the Cantabro Test. More particularly, the fly loss was measured by making a cylinder under test having a diameter of 10 cm and height of 5 cm, arranging the cylinder in a Los Angeles test machine, rotating a drum 300 times without using a steel sphere and measuring the mass of the cylinder after rotated so as to get a percentage of lost mass to the mass prior test.

COMPARISON EXAMPLE 2

(a) Manufacture of a Porous Concrete Structure

Compound and knead rough aggregates having a diameter of 2 to 10 mm, Portland cement and water with the ratio of water to the Portland cement 30% and the ratio of the Portland cement to the rough aggregates 20% where the unit cement weight is 295 kg/m$^3$ and the unit rough aggregate weight is 1500 kg/m$^3$. Place the kneaded concrete into a predetermined form. Detach the concrete from the form after the concrete is cured so as to obtain a porous concrete structure. The porous concrete structure had a porous structure where each of the rough aggregates was connected with cement paste and kept in a contact at a point and voids thereof was 15 to 25%.

(b) Strength of the Porous Concrete Structure

The porous concrete in accordance with the comparison example 2 showed as follows: The compressive strength read 100 to 200 Kgf/cm$^2$, the flexural strength read 20 to 25 kgf/cm$^2$ and the fly loss read 15 to 30%.

COMPARISON EXAMPLE 3

(a) Manufacture of a Porous Concrete Structure

Compound and knead rough aggregates having a diameter of 2 to 5 mm, Portland cement and water with the ratio of water to the Portland cement 25% and the ratio of the Portland cement to the rough aggregates 40% where the unit cement weight is 470 kg/m$^3$ and the unit rough aggregate weight is 1150 kg/m$^3$. Place the kneaded concrete into a predetermined form. Detach the concrete from the form after the concrete is cured so as to obtain a porous concrete structure. The porous concrete structure had a porous structure where each of the rough aggregates was connected with cement paste and kept in a contact at a point and voids thereof was 15%.

(b) Strength of the Porous Concrete Structure

The conventional porous concrete in accordance with the comparison example 3 showed as follows: The compressive strength read 250 to 300 Kgf/cm$^2$, the flexural strength read 30 to 40 kgf/cm$^2$ and the fly loss read 10 to 20%.

(Embodiment 1)

(1) Manufacture of a Form

Place the porous concrete structure in accordance with the comparison example 1 which serves as a matrix in a container. Pour a melted thermoplastic material, for example, the above-mentioned "EM" which has previously been heated to 210° C. into the container. Then cure the thermoplastic material at a room temperature. Steam cure may be provided to gain the curing speed. Detach the cured thermoplastic material from the porous concrete structure so as to obtain a form of the thermoplastic material in accordance with FIG. 7. This form can transfer a gap having a backdraft because it is made of elastomerics.

(2) Manufacture of High Strength Porous Concrete Structure

Figure 9:
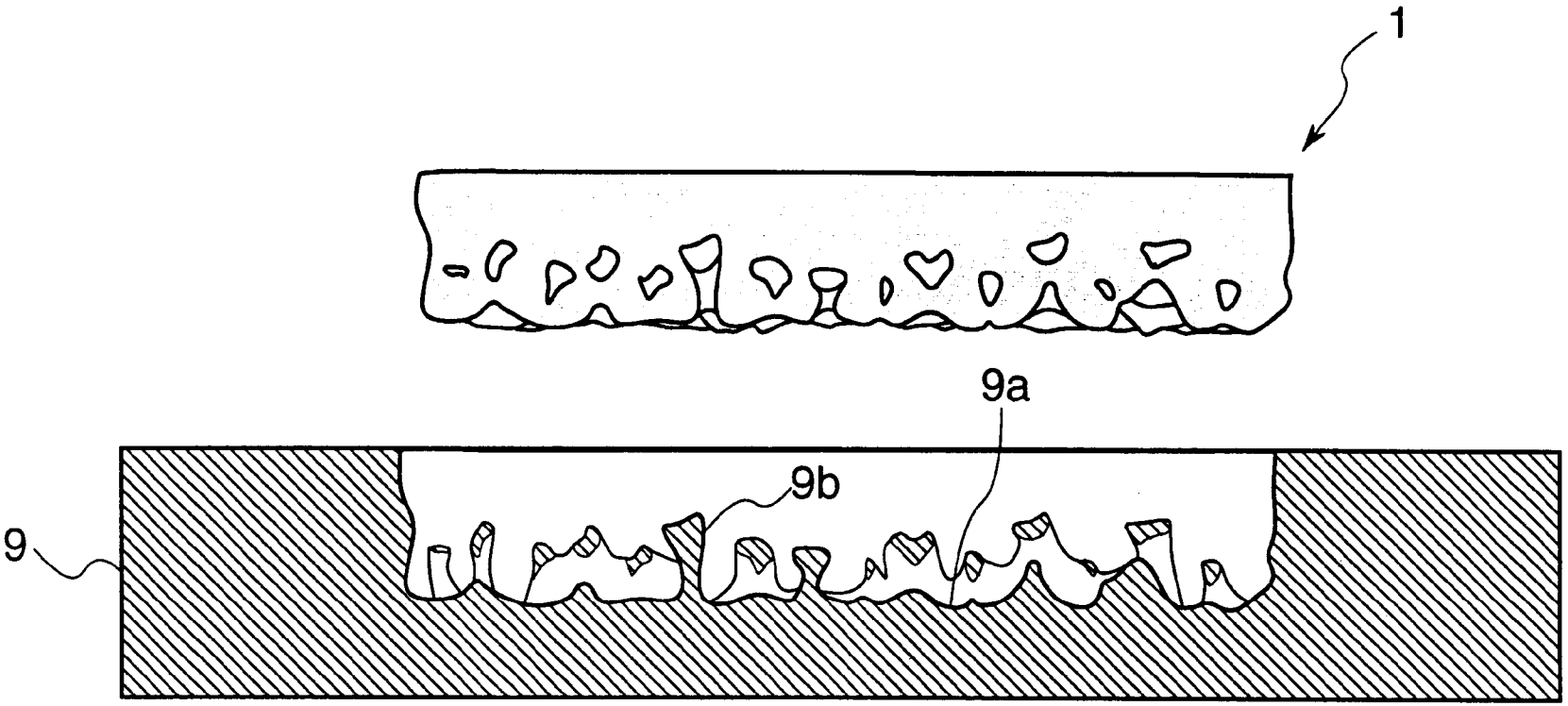
FIG. 9 is a view to explain the above-mentioned method.
Figure 10:
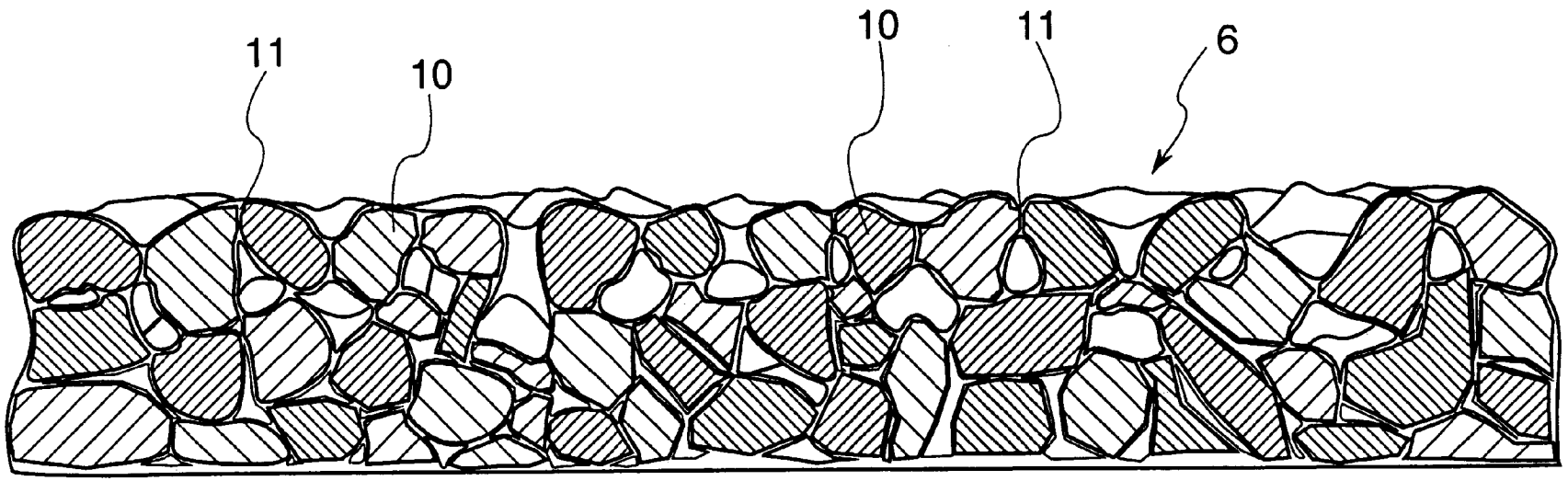
FIG. 10 is a cross sectional view showing a conventional porous concrete structure.

Compound and knead aggregates having a diameter of 0 to 5 mm, Portland cement and water into mortar concrete with the ratio of water to the Portland cement 45% where the unit cement weight is 460 kg/m$^3$ and the unit aggregate weight is 1100 kg/m$^3$. Place the kneaded concrete into the above-mentioned form. Steam cure the concrete for three hours at 70° C. Detach the concrete from the form after the concrete is cured so as to obtain a high strength porous concrete structure 1 shown in FIG. 9. The high strength porous concrete structure 1 had almost the same appearance as that of the conventional porous concrete structure since it was transferred through the above-mentioned form from the configuration of the matrix. The high strength porous concrete structure 1 in accordance with the embodiment 1 comprised a porous surface layer of 25 mm in thickness and a tight solid backing layer of 25 mm in thickness. The voids of the porous surface layer was approximate 20%.

(3) Strength of the High Strength Porous Concrete Structure

The high strength porous concrete in accordance with the embodiment 1 showed as follows: The compressive strength read 300 to 400 Kgf/cm$^2$, the flexural strength read 40 to 60 kgf/cm$^2$ and the fly loss read 5% or below.

(Embodiment 2)

(1) Manufacture of a Form

Manufacture a form as the same as the embodiment 1 by using the porous concrete structure in accordance with the comparison example 1 as a matrix for the form.

(2) Manufacture of High Strength Porous Concrete Structure

Compound and knead aggregates having a diameter of 0 to 10 mm, Portland cement and water into concrete with the ratio of water to the Portland cement 30% where the unit cement weight is 440 kg/m$^3$ and the unit aggregate weight is 1200 kg/M$^3$. Place the kneaded concrete into the above-mentioned form. Steam cure the concrete for three hours at 70° C. Detach the concrete from the form after the concrete is cured so as to obtain a high strength porous concrete structure. The high strength porous concrete structure in accordance with the embodiment 2 comprised a porous surface layer of 15 mm in thickness and a tight solid backing layer of 35 mm in thickness. The voids of the porous surface layer was approximate 20%.

(3) Strength of the High Strength Porous Concrete Structure

The high strength porous concrete in accordance with the embodiment 2 showed as follows: The compressive strength read 400 to 500 Kgf/cm$^2$, the flexural strength read 50 to 70 kgf/cm$^2$ and the fly loss read 5% or below.

(Embodiment 3)

(1) Manufacture of a Form

Manufacture a form as the same as the embodiment 1 by using the porous concrete structure in accordance with the comparison example 1 as a matrix for the form.

(2) Manufacture of High Strength Porous Concrete Structure

Compound and knead aggregates having a diameter of 0 to 5 mm, polymer cement and water into polymer cement concrete with the ratio of water to the polymer cement 40% where the unit cement weight was 240 kg/m$^3$ and the unit aggregate weight was 1400 kg/m$^3$. Place the kneaded concrete into the above-mentioned form. A rubber latex, a thermoplastic dispersion or a thermosetting dispersion may be used as a latex for such polymer cement. Steam cure the concrete for three hours at 70° C. Detach the concrete from the form after the concrete is cured so as to obtain a high strength porous concrete structure. The high strength porous concrete structure in accordance with the embodiment 3 comprised a porous surface layer of 25 mm in thickness and a tight solid backing layer of 25 mm in thickness. The voids of the porous surface layer was approximate 20%.

(3) Strength of the High Strength Porous Concrete Structure

The high strength porous concrete in accordance with the embodiment 3 showed as follows: The compressive strength read 400 to 500 Kgf/cm$^2$, the flexural strength read 100 to 160 kgf/cm$^2$ and the fly loss read 5% or below.

(Embodiment 4)

(1) Manufacture of a Form

Manufacture a form as the same as the embodiment 1 by using the porous concrete structure in accordance with the comparison example 1 as a matrix.

(2) Manufacture of High Strength Porous Concrete Structure

Compound and knead aggregates having a diameter of 0 to 5 mm, Portland cement and water into light-weight bubble mortar to which aluminum powder or a foaming agent as an air entraining agent is introduced little by little with the ratio of water to the cement 45% where the unit cement weight is 400 to 500 kg/m$^3$ and the unit aggregate weight is 200 to 300 kg/m$^3$. Place the kneaded concrete into the above-mentioned form. Steam cure the concrete for three hours at 70° C. Detach the concrete from the form after the concrete is cured so as to obtain a high strength porous concrete structure. The high strength porous concrete structure in accordance with the embodiment 4 comprised a porous surface layer of 25 mm in thickness and a tight solid backing layer of 25 mm in thickness. The voids of the porous surface layer was approximate 50 to 80%.

(3) Strength of the High Strength Porous Concrete Structure

The high strength porous concrete in accordance with the embodiment 4 showed as follows: The compressive strength read 50 to 100 Kgf/cm$^2$, the flexural strength read 10 to 30 kgf/cm$^2$ and the fly loss read 30 to 60% or below. The high strength porous concrete is suitable for a sound-proofing material which does not require high strength.

Table 1 shows the combination and strength of the comparison examples 1, 2 and 3 and table 2 shows the combination and strength of the embodiments 1, 2, 3 and 4.

TABLE 1

Combination and Strength of Comparison Examples 1, 2, 3 and 4

| | Comparison Example 1 | Comparison Example 2 | Comparison Example 3 |
|---|---|---|---|
| Diameter of Aggregate (mm) | 10~20 | 2~10 | 2~5 |
| Ratio of Water to Cement (%) | 28 | 30 | 25 |
| Ratio of Cement to Aggregate (%) | 17 | 20 | 40 |
| Unit Cement weight (Kg/m$^3$) | 260 | 295 | 470 |
| Unit Aggregate Weight (Kg/m$^3$) | 1560 | 1500 | 1150 |
| Unit Latex Weight(KG/m$^3$) | | | |
| Voids (%) | 20~30 | 15~25 | 15 |
| Compressive Strength (Kgf/cm$^2$) | 100~200 | 100~200 | 250~300 |
| Flexural Strength (kgf/cm$^2$) | 15~20 | 25~25 | 30~40 |
| Fly Loss (Weight Loss Rate) | 20~40% | 15~30% | 10~20% |

TABLE 2

Combination and Strength of Embodiments 1, 2, 3 and 4

| | Embodiment 1 Mortar concrete | Embodiment 2 Concrete | Embodiment 3 Polymer-cement Concrete | Embodiment 4 |
|---|---|---|---|---|
| | | | | Light-weight Bubble mortar |
| Diameter of Aggregate (mm) | 0~5 | 1~10 | 0~5 | 0~5 |
| Water to Cement Ratio (%) | 45 | 30 | 40 | 45 |
| Cement to Aggregate Ratio (%) | | | | |
| Unit Cement Weight (Kg/m$^3$) | 460 | 440 | 240 | 400~500 |
| Unit Aggregate Weight (Kg/m$^3$) | 1100 | 1200 | 1400 | 200~300 |
| Unit Latex Weight (KG/m$^3$) | | | 80 | |
| | | | | Aluminum Powder (Air Entraining Agent) Foaming Agent |
| Voids (%) | 20 | 20 | 20 | 50~80 |
| Compressive strength (Kgf/cm$^2$) | 300~400 | 400~500 | 400~500 | 50~100 |

As is clear from the above tables, the embodiments 1, 2 and 3 showed a very high value in both of the compressive strength and the flexural strength and a good value in the fly loss when compared to the conventional comparison examples 1, 2 and 3 although the voids were almost the same. Generally it is considered acceptable for pavements if fly loss is 30% or below. As a result of this, the embodiments 1, 2 and 3 are suitable for pavement since each of the fly loss showed 5% or below.

The embodiment 4 is not suitable for pavements since it is low in both the compressive strength and the flexural strength and the fly loss thereof is 30 to 60%. However, the embodiment 4 has a large surface area which is exposed to outside as well as it is light, since the voids thereof are high such as 50 to 80%. As a result of this, it is suitable for sound absorbing material which does not require high strength and can be expected to produce a high sound absorbing effect. It is suitable also for purifying water since the porous structure can effectively provide residential areas for algae or fungi.

In addition to the embodiments 1, 2 and 3, there are other high strength porous concrete structures as shown in embodiments 5 and 6 as a high strength porous concrete structure in accordance with the invention wherein water permeability or a draining function is superior. Hereinafter the same reference numeral will be given to the same element.

(Embodiment 5)

Figure 11:
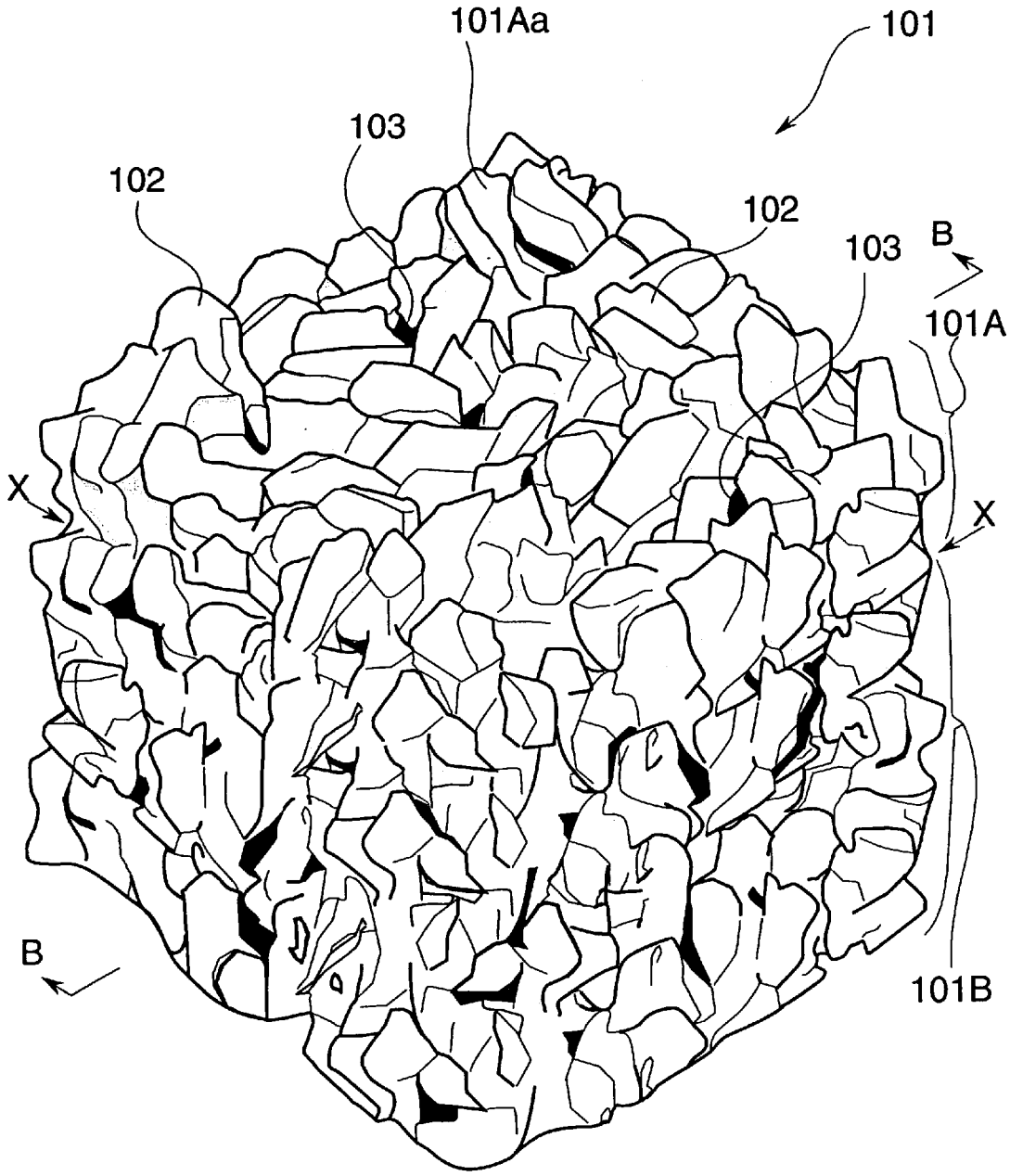
FIG. 11 is a perspective view showing the embodiment 5 of the invention.
Figure 12:
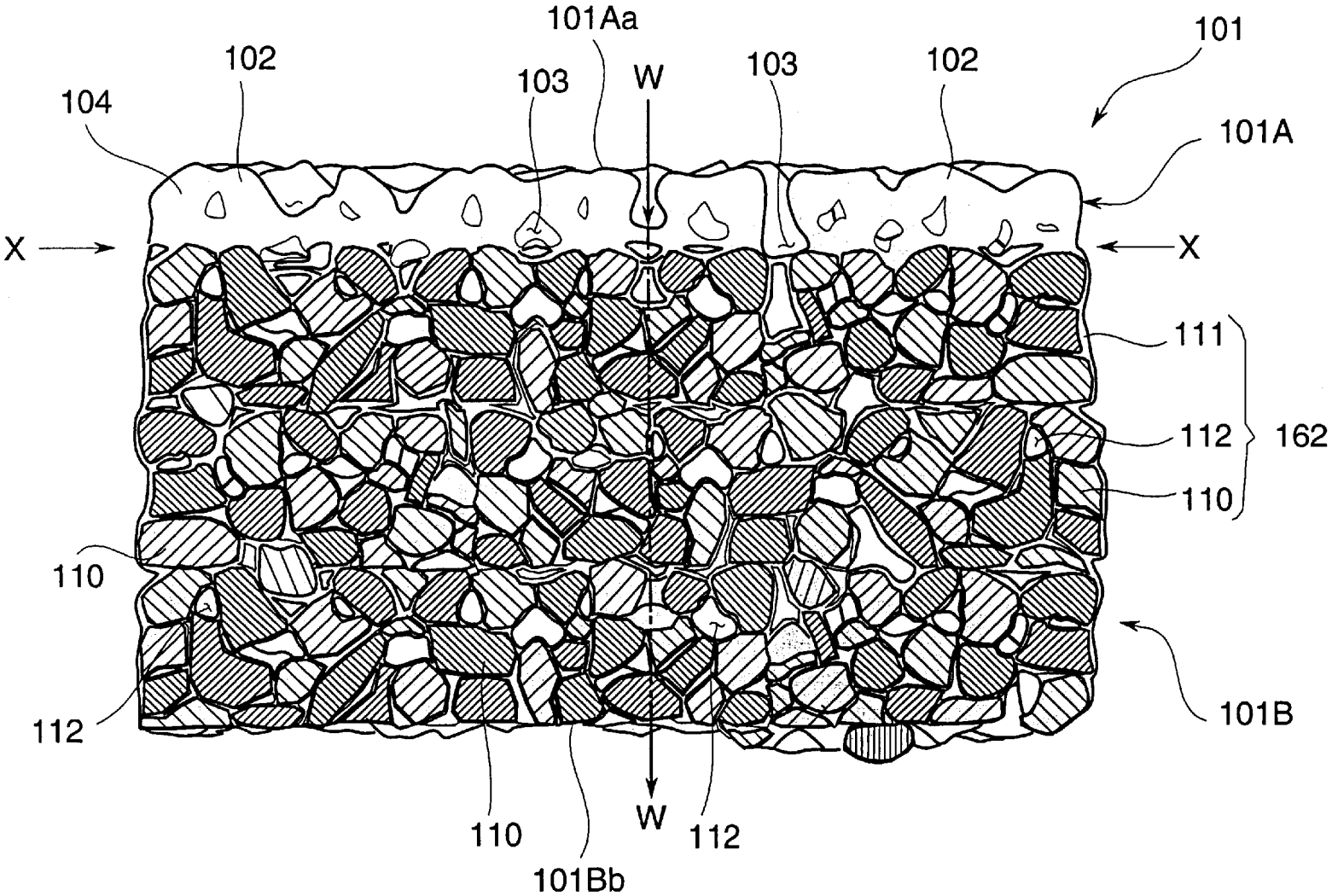
FIG. 12 is a cross sectional view of FIG. 11 taken along line B—B.
Figure 13:
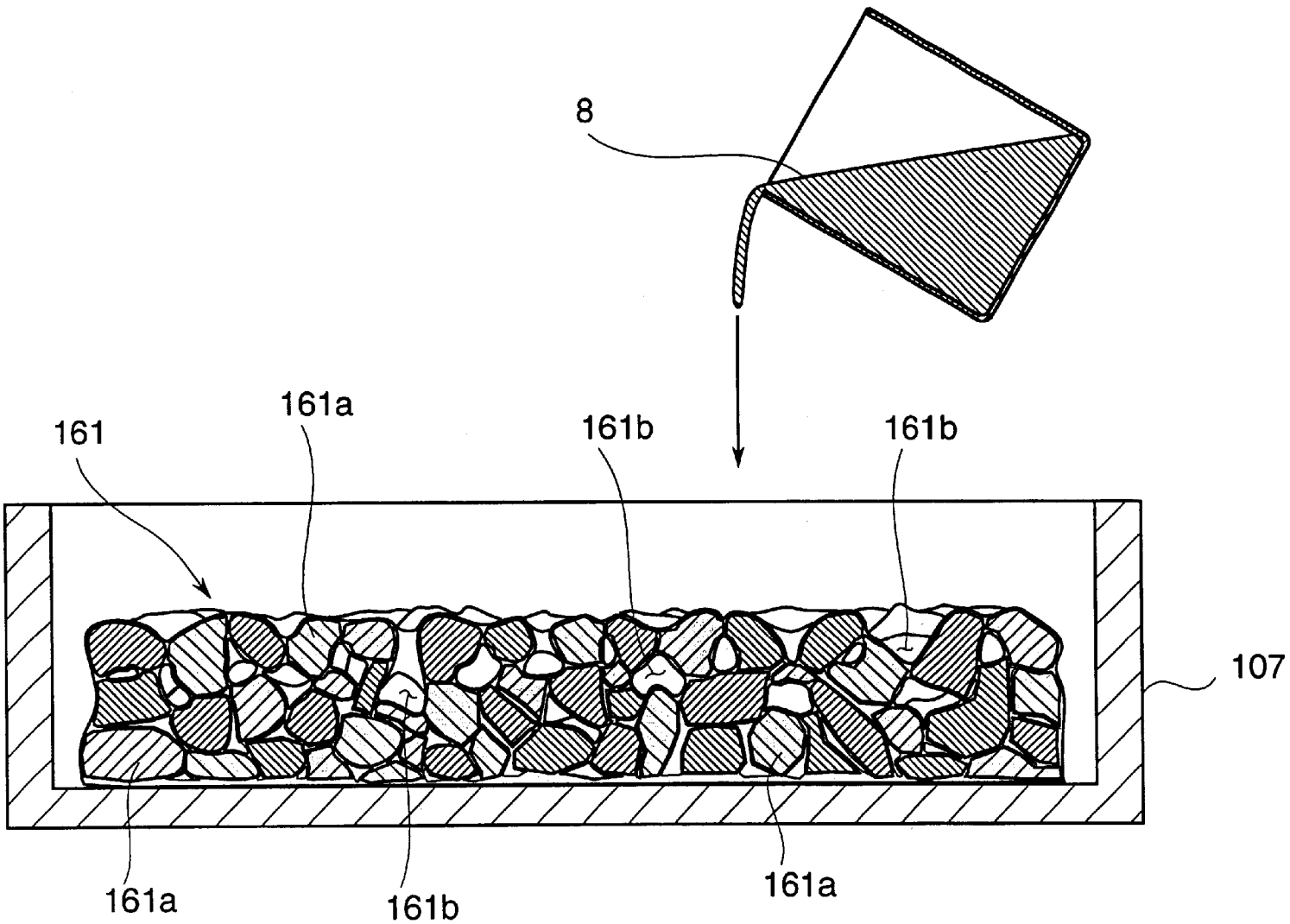
FIG. 13 is a view to explain a method of manufacturing a high strength porous concrete structure in accordance with another embodiment of the invention.
Figure 14:
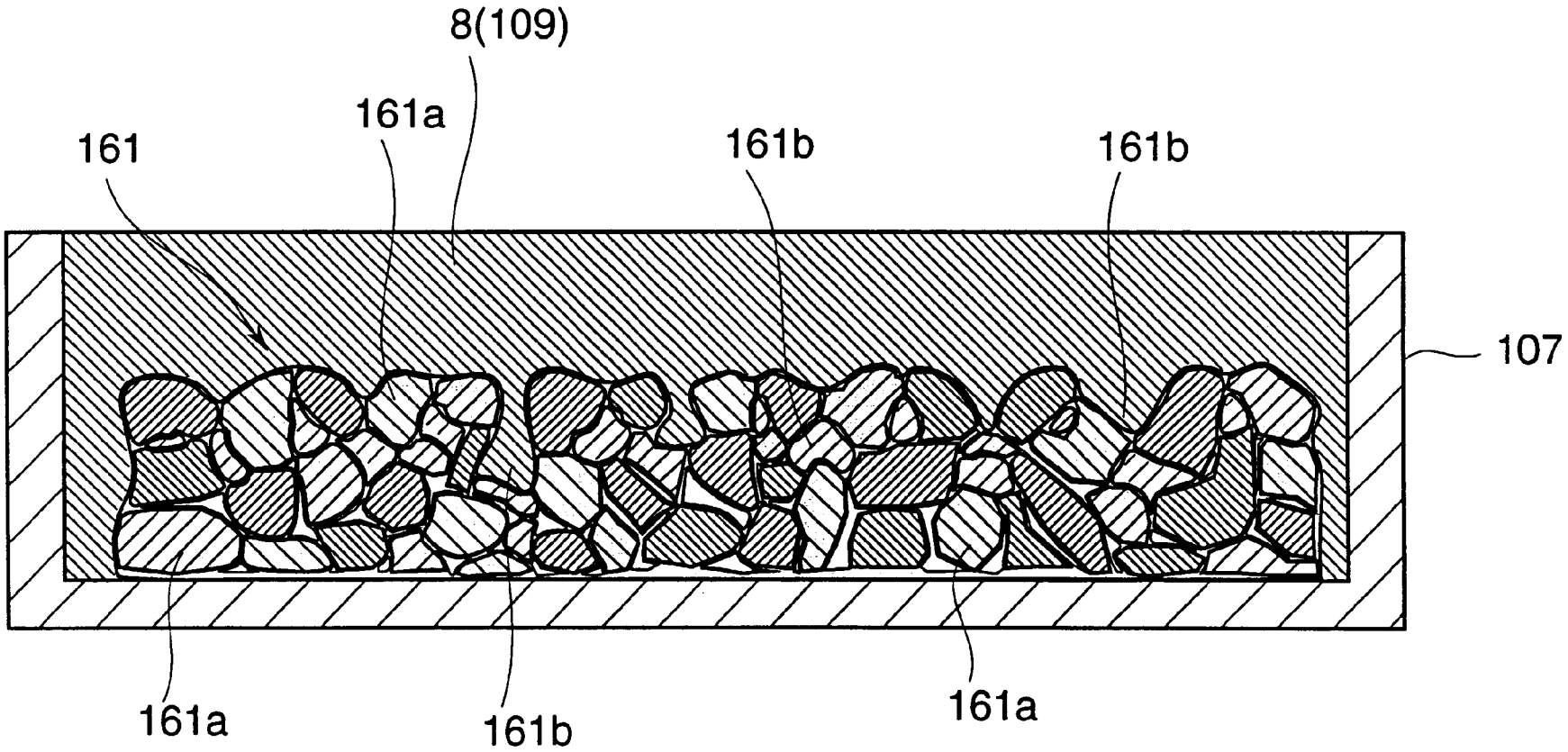
FIG. 14 is a view to explain the above-mentioned method.
Figure 15:
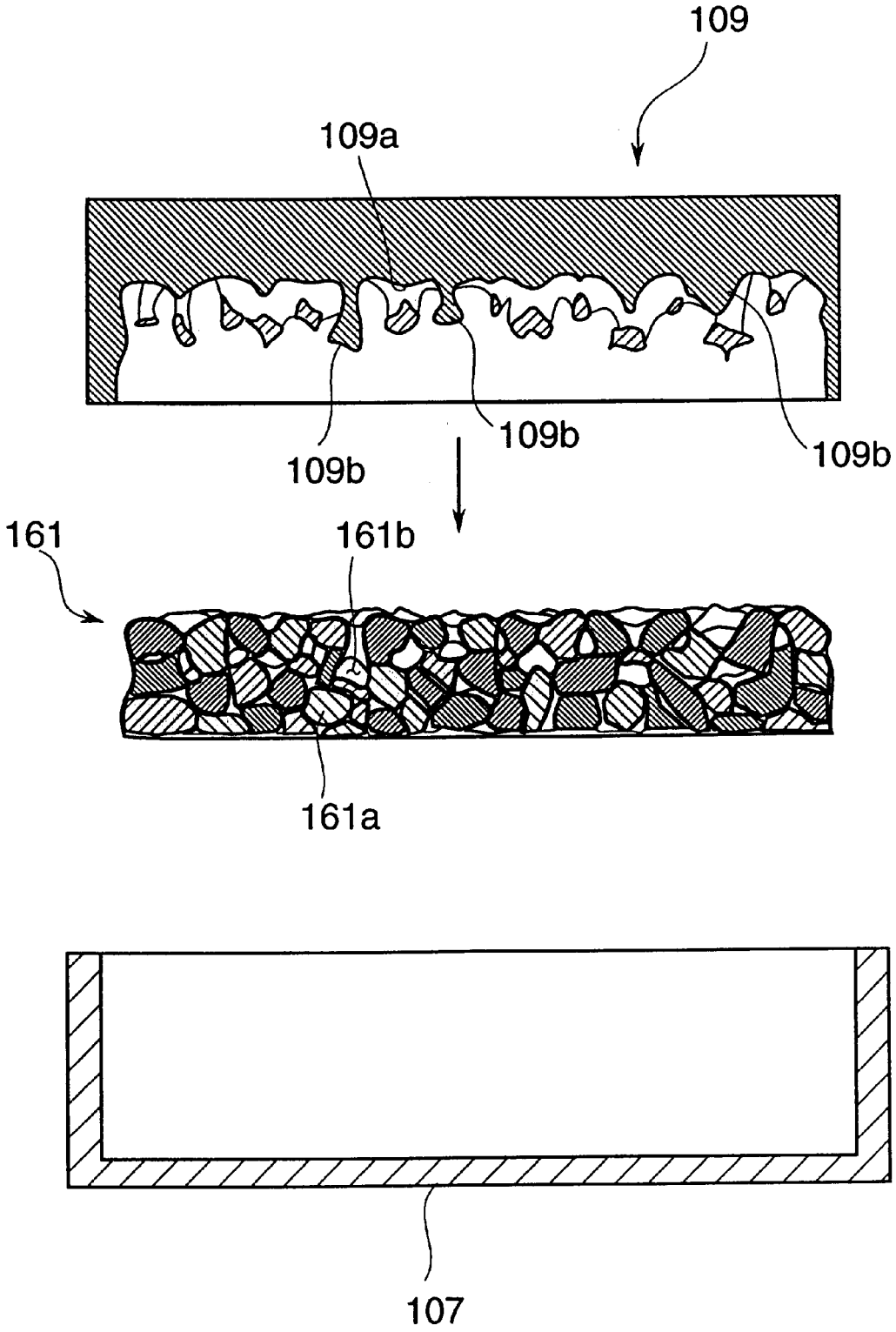
FIG. 15 is a view to explain the above-mentioned method.
Figure 16:
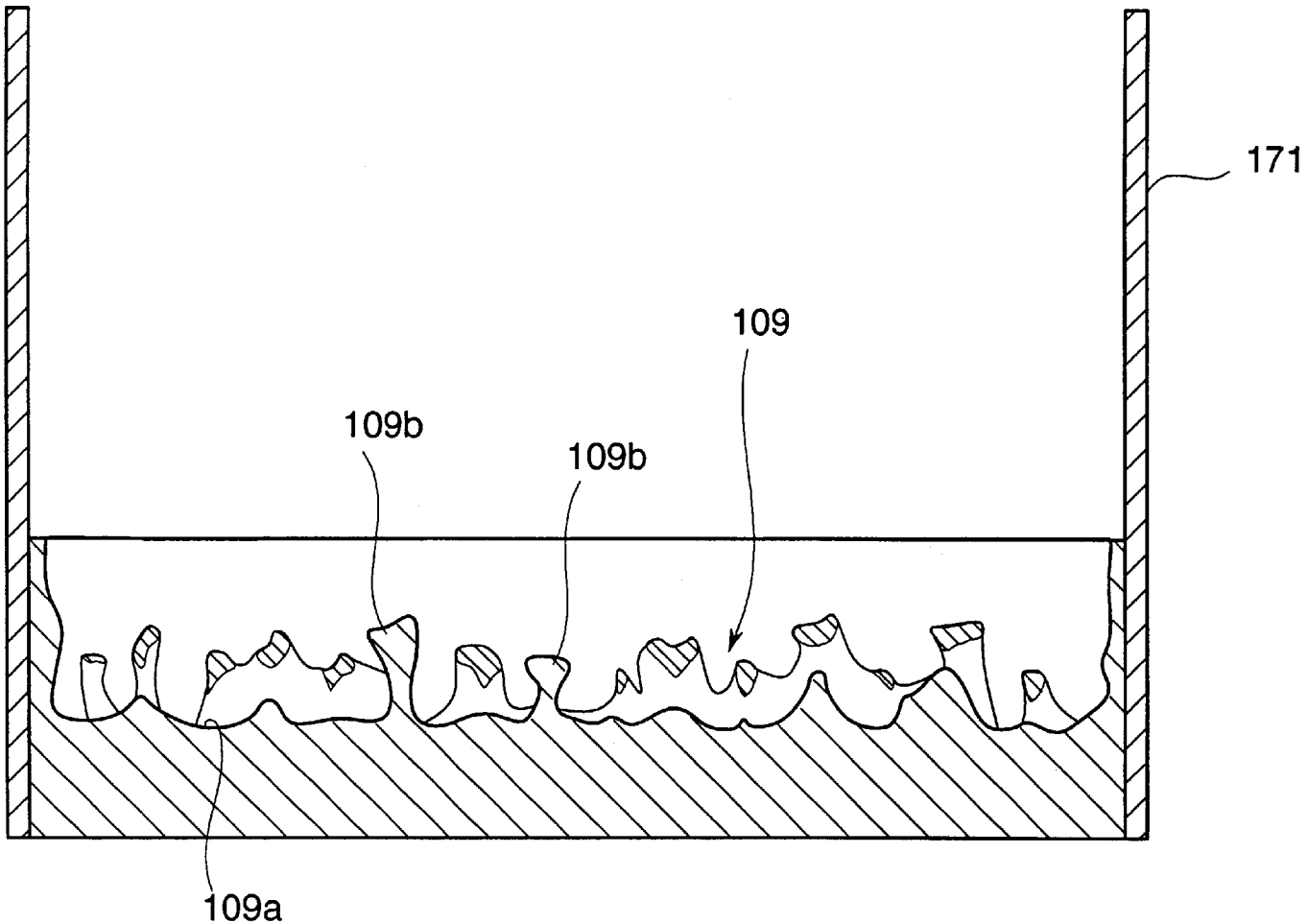
FIG. 16 is a view to explain the above-mentioned method.
Figure 17:
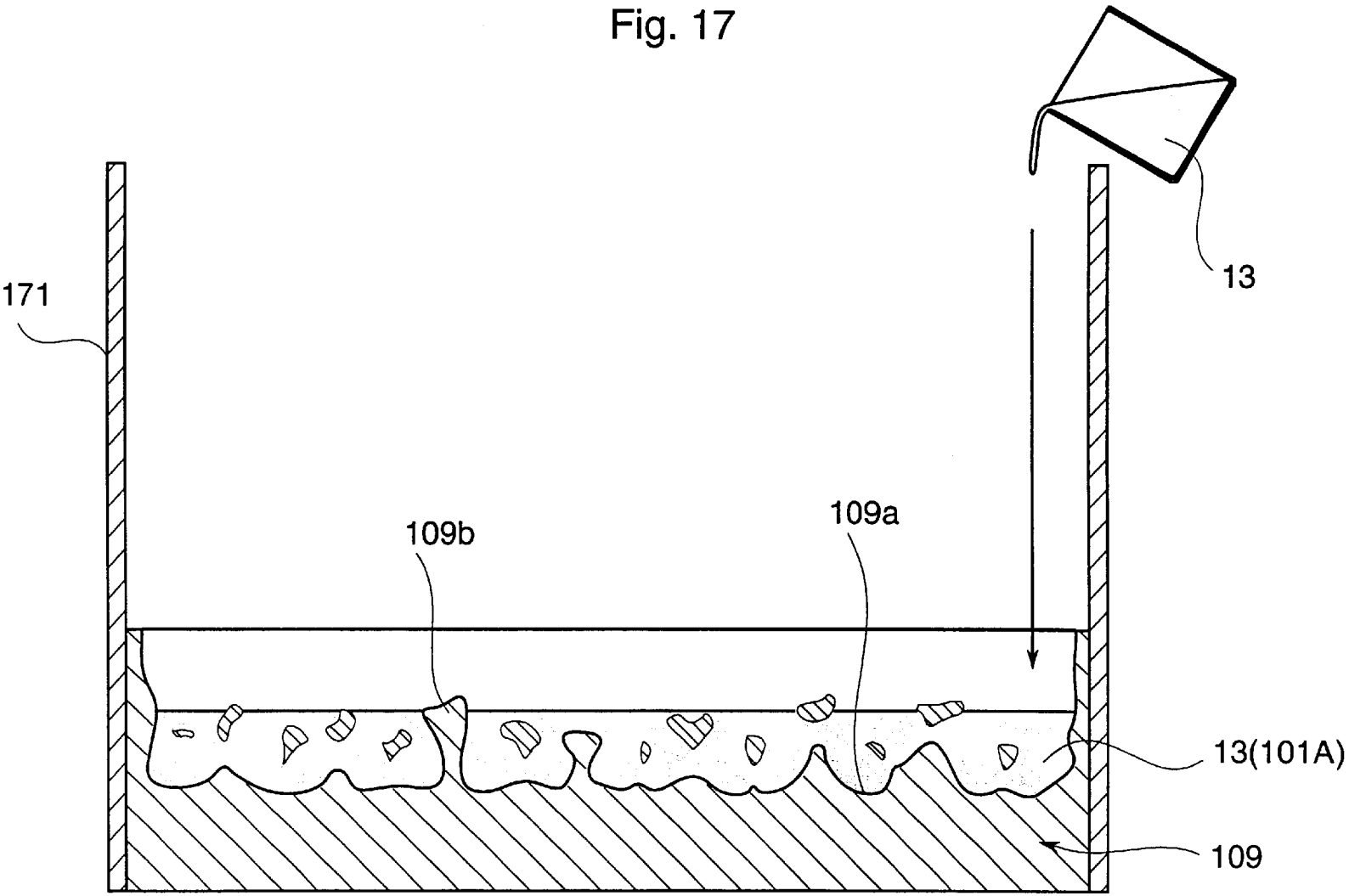
FIG. 17 is a view to explain the above-mentioned method.
Figure 18:
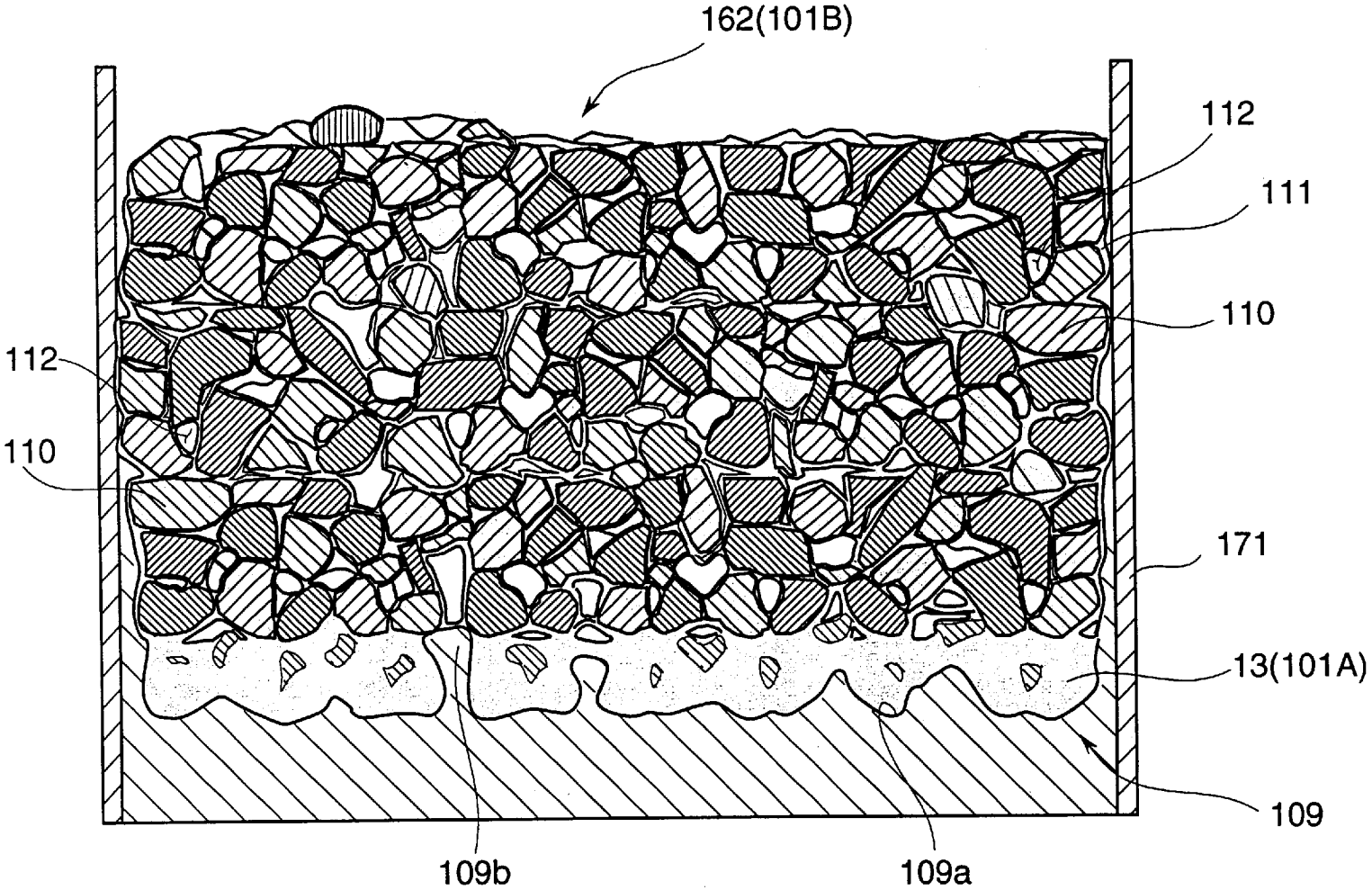
FIG. 18 is a view to explain the above-mentioned method.

The high strength porous concrete structure 101 shown in FIGS. 11 and 12 comprises a surface layer 101A made of concrete tissue 104 and a backing layer 101B made of conventional porous concrete 162 and which is united with the surface layer 101A. On the surface 101Aa of the surface layer 101A provided are a plurality of lumps 102 having a configuration of rough aggregates each of which is interconnected and exposed to a surface 101Aa of the surface layer 101A and between the lumps 102 formed is a gap 103 which is through from the surface 101Aa to a boundary X between the surface layer 101A and the backing layer 101B. The surface layer 101A of the high strength porous concrete structure 101 is similar to that of the high strength porous structure 1 in accordance with the embodiment 1 and manufactured by the following procedures. First, manufacture a form 109 by means of a procedure similar to the embodiment 1 by using the conventional porous concrete structure 6 in accordance with the comparison example 1 as a matrix for the form 109. More specifically, as shown in FIG. 13, place the porous concrete structure 6 in a container 107, pour a thermoplastic material into the container 107 and leave it for a while at a room temperature until the thermoplastic material 8 cures. Then the form 109 is manufactured as shown in FIG. 14. Detach the form 109 from an original material 161 to be transferred by making use of plastic deformation of the form 109. On the form 109 formed are a concave portion 109*a* whose configuration corresponds to that of the rough aggregates 161*a* and a soft projection 109*b* whose configuration corresponds to that of the gap 161*b* between the rough aggregates 161*a*. Arrange the form 109 in the center of a body frame 171 as shown in FIG. 16 and then place mortar or concrete 13 into the form 109 as shown in FIG. 17 so as to form the surface layer 101A. Prior to curing the surface layer 101A, place the porous concrete 162 made of rough aggregates 110 having the same combination as that of the comparison example 1 over the base of the surface layer 101A so as to form the backing layer 101B as shown in FIG. 18. Cure the mortar 13 and the porous concrete 162. Detach the body frame 171 from the form 109 and then draw to detach the form 109 from the high strength porous concrete structure 101 by making use of the plastic deformation of the form 109. Finally the high strength porous concrete structure 101 as shown in FIG. 12 is obtained.

Thus manufactured high strength porous concrete structure 101 of this embodiment has a water permeability on the whole since the gap 103 formed between the lumps 102 of the surface layer 101A is through from the surface 101Aa of the surface layer 101A to the boundary X between the surface layer 101A and the backing layer 101B. More specifically, as shown in FIG. 12. water W which soaks into the surface 101Aa of the surface layer 101A goes down along the gap 103 of the surface layer 101A, passes the boundary X and reaches a gap 112 of the backing layer 101B so as to be discharged to outside.

Although having generally the same voids as those of the comparison examples 1, 2 and 3, the high strength porous concrete structure 101 showed a satisfactory reading in flying loss, namely, 5% or below like embodiment 1. As a result of this, the high strength porous concrete structure 101 is suitable for pavements.

In order to apply the high strength porous concrete structure 101 to a pavement one piece of the high strength porous concrete structures 101 is used as one unit structure and a plurality of the high strength porous concrete structures 101 are placed continuously with its surface layer 101A exposing to the surface of the pavement. As described above, the fly loss showed a very satisfactory reading. As a result of this, the pavement using the high strength porous concrete structure 101 can prevent the surface 101Aa of the surface layer 101A from detaching to fly when a big stress is applied to the surface of the pavement when vehicles brake. Therefore, the high strength porous concrete structure 101 can suitably be applied to pavements in respect to both water permeability and strength.

Figure 19:
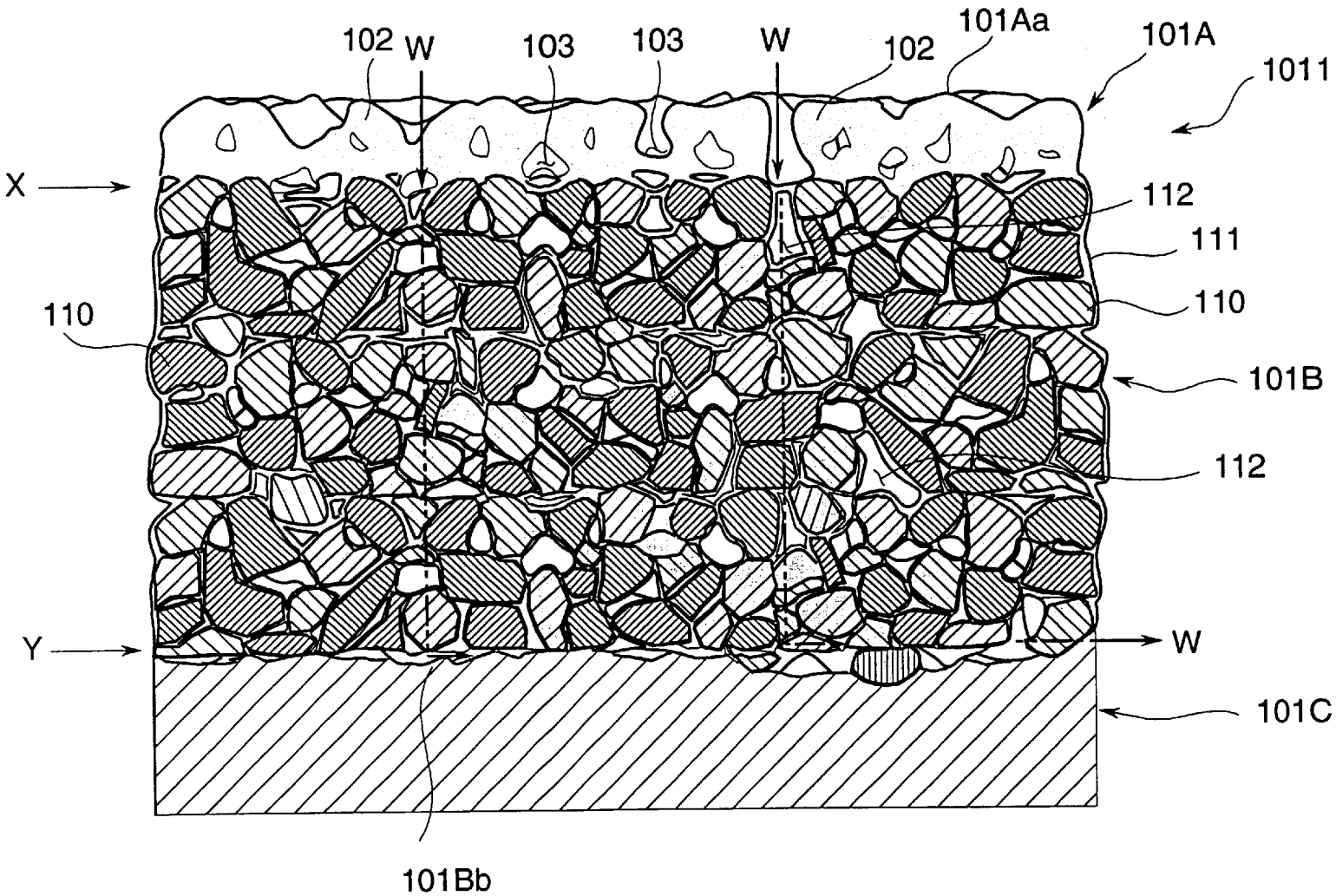
FIG. 19 is a cross sectional view showing the high strength porous concrete structure in accordance with the embodiment with which a function of draining is provided.

In order to add a draining function to the above high strength porous concrete structure, a solid tight concrete layer 101C may be formed under the base 101Bb of the backing layer 101B as shown in FIG. 19. In this case water W which soaks into the surface 101Aa of the surface layer 101A goes down, as shown by an arrow in FIG. 19, through a gap 103 of the surface layer 101A and a gap 112 of the backing layer 101B and to a boundary Y between the backing layer 101B and a concrete layer 101C so as to be discharged from drainage not shown in drawings. As a result of this, the high strength porous concrete structure 1011 can be used as an excellent pavement.

(Embodiment 6)

Figure 20:
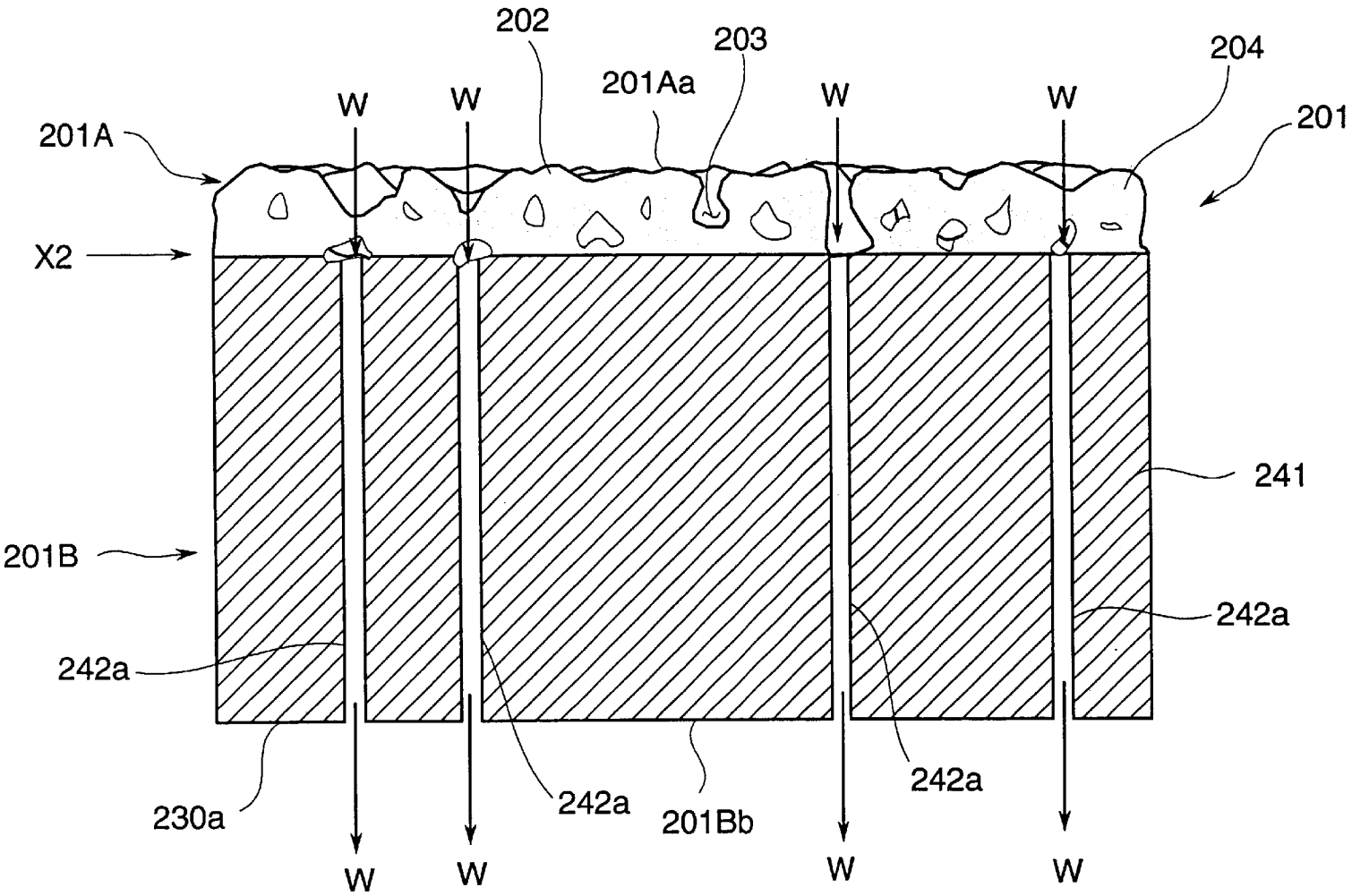
FIG. 20 is a cross sectional view showing further different embodiment of the invention.

FIG. 20 shows a high strength porous concrete structure 201 which comprises a surface layer 201A made of concrete tissue 204 and a backing layer 201B made of solid tight concrete tissue 241 and which is united with the surface layer 201A. On the surface layer 201A provided are a plurality of lumps 202 having a configuration of a rough aggregate each of which are interconnected and exposed to a surface of the high strength porous concrete structure. Between the lumps 202 formed is a gap which is connected from the face 201Aa to a boundary X2 to the backing layer 201B. The backing layer 201B is provided with a plurality of water permeable holes 242*a* as a water through hole which penetrates the base 201Bb of the backing layer 201B through the boundary X2. Since the surface layer 201A has the same arrangement as the surface layer 101A of the embodiments 1 and 5, the fly loss of the high strength porous concrete structure 201 is suitable for a pavement. Since water W which soaks into the surface 201Aa of the surface layer 201A goes down to a boundary X2 between the surface layer 201A and the backing layer 201B through the gap 203, as shown by an arrow in FIG. 20, and then is discharged through the water permeable hole 242*a* to underground, the high strength porous concrete structure 201 is excellent in water permeability. As a result of this, the high strength porous concrete structure 201 can be used as an extremely good pavement because of its water permeability and strength.

Figure 21:
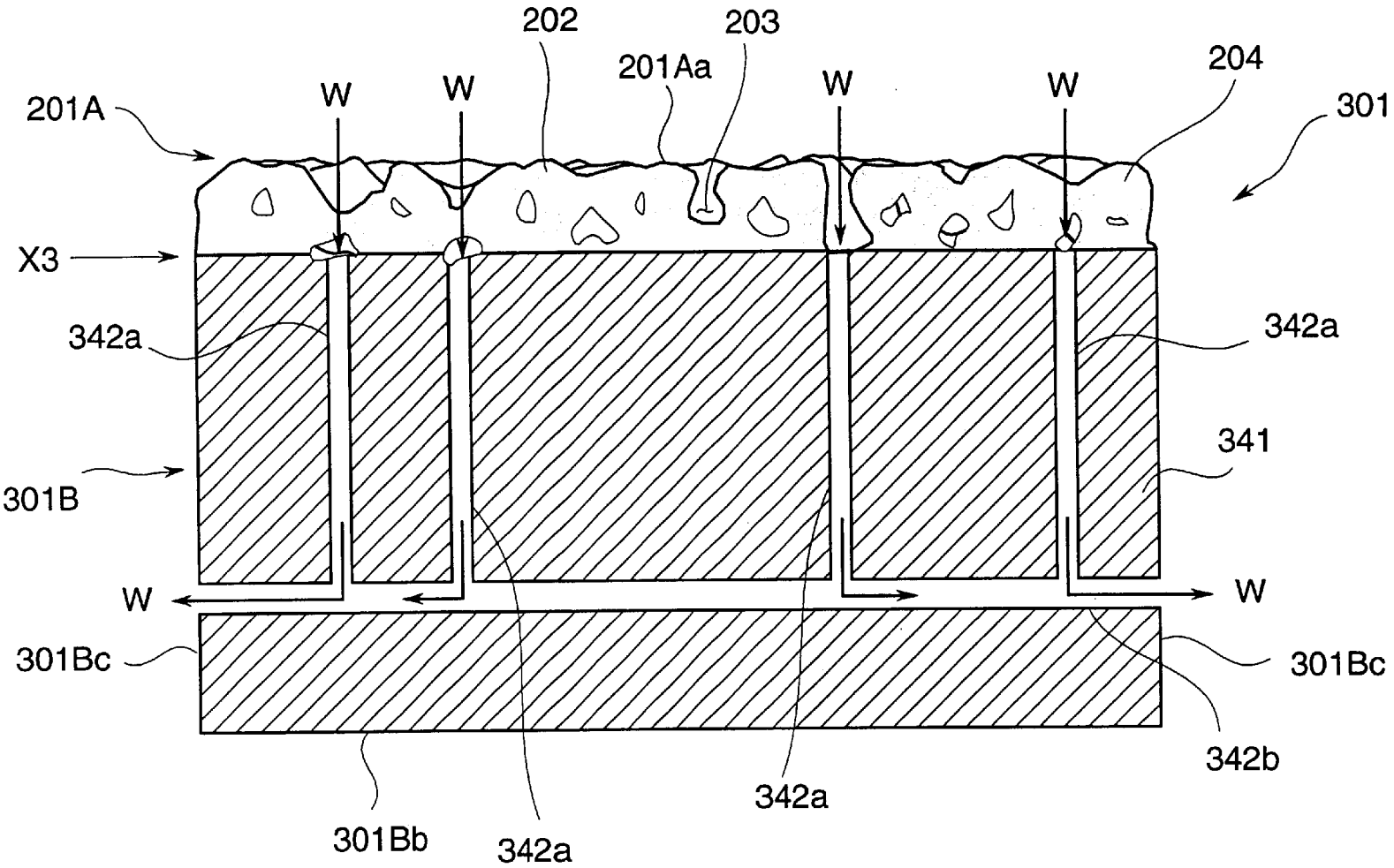
FIG. 21 is a cross sectional view showing the high strength porous concrete structure in accordance with the further different embodiment with which a function of draining is provided.

In order to add a draining function to the high strength porous concrete structure, the high strength porous concrete structure 201 may be, as shown in FIG. 21, provided with a plurality of water permeable holes 342*a* each of which begins with a boundary X3 between the surface layer 201A and the backing layer 301B and end with an extending end which does not reach the base surface 301Bb of the backing layer 301B and a discharging hole 342*b* which connects each of the extending ends of the water permeable holes 342*a*. In accordance with the arrangement, since the gap 203 in the surface layer 201A penetrates a discharging hole 342*b* through the water permeable hole 342*a,* water W which soaks into the surface 201Aa of the surface layer 201A goes down to the boundary X3 between the surface layer 201A and the backing layer 301B through the gap 203, as shown by an arrow in FIG. 21, and then is discharged through the water permeable hole 342*a* from the water discharging hole 342*b* to underground, the high strength porous concrete structure 301 shows an excellent performance in water permeability. As a result of this, the high strength porous concrete structure 301 can be used as pavements because of its water permeability and strength.

In order to manufacture the high strength porous concrete structures 201 and 301 where the backing layers 201B and 301B made of solid tight concrete tissue 241 and 341 are provided with the water permeable holes 242*a,* 342*a* and 342*b,* form a form and a surface layer as the same method of the embodiment 5, form the water permeable holes 242*a,* 342*s* or 243*b* by setting up a pipe or something like that prior to curing the mortar of the surface layer, and then place concrete tissue 203, 241 or 341 in the form.

Figure 22:
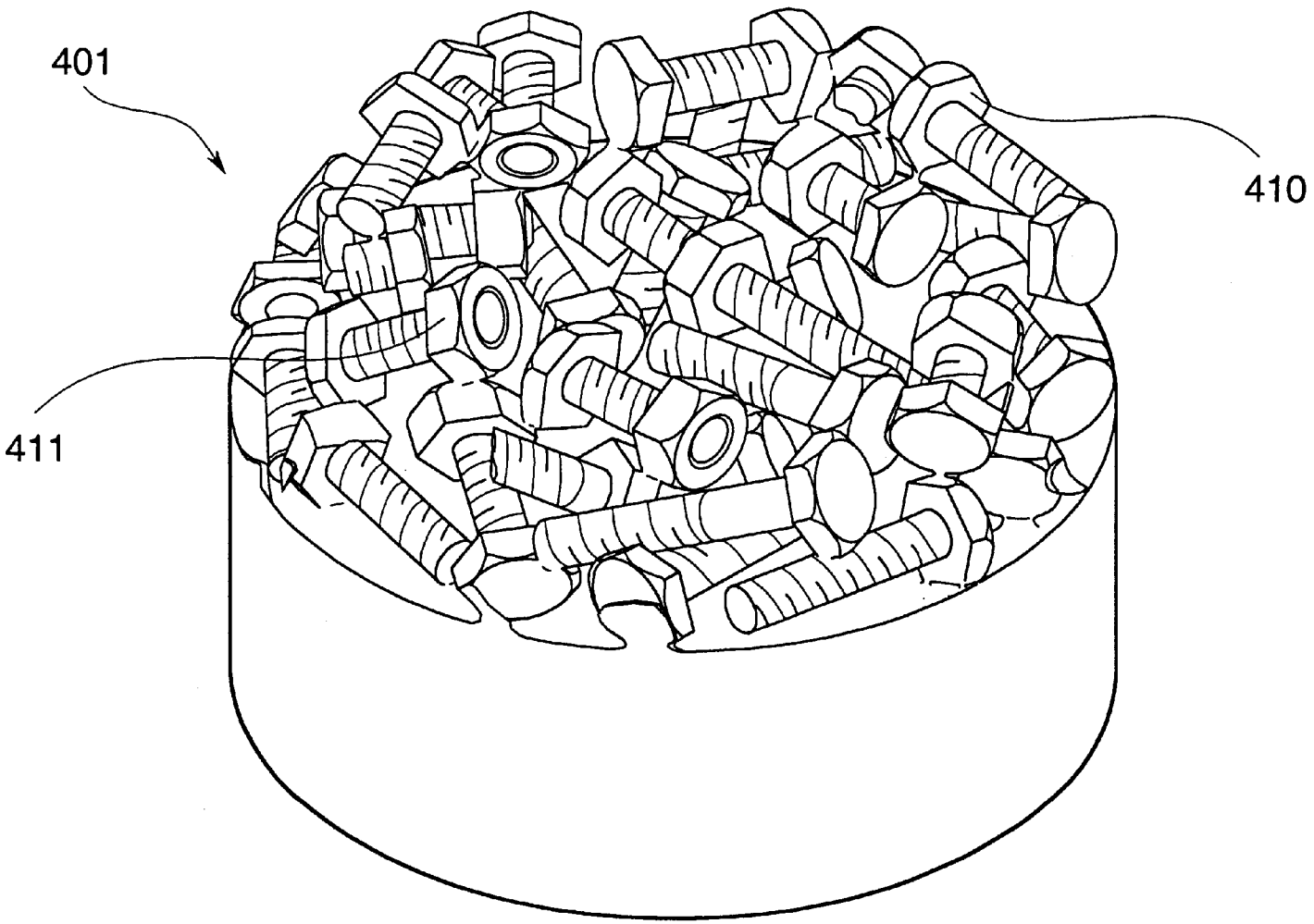
FIG. 22 is a referential perspective view showing another different embodiment of the invention.

Each of the arrangements of the invention is not limited to the embodiments described in detail hereinabove. For example, the original material to be transferred is not limited to the the above-described porous concrete structure, but may be a bolt 410, a nut 411, or a metal lump such as a tool so as to obtain a high strength porous concrete structure 401 as shown in FIG. 22. The original material to be transferred may be a glass lump such as a marble, a ceramic lump or a synthetic resin lump.

Moreover, there may be various modifications without departing from the spirit and essential characteristics thereof.

What is claimed is:

1. A high strength porous concrete structure having a surface configuration corresponding to a surface configuration of an original object, manufactured by a method comprising the steps of:

contacting a heated-to-melt thermoplastic material, which cures to an elastically deformable form, with a surface of the original object;

curing the thermoplastic material to make the elastically deformable form;

detaching the elastically deformable form from the original object;

placing mortar or concrete into the elastically deformable form; and curing the mortar or concrete to obtain the high strength porous concrete structure, wherein a plurality of lumps whose surface configuration is similar to the surface configuration of the original object are interconnected and exposed to a surface of the high strength porous concrete structure and a gap is formed between said lumps through to a back side of the lumps, wherein said lumps are arranged over all the thickness of said high strength porous concrete structure and the lumps are integrally formed of the same concrete.

2. A high strength porous concrete structure having a surface configuration corresponding to a surface configuration of an original object, manufactured by a method comprising the steps of:

contacting a heated-to-melt thermoplastic material, which cures to an elastically deformable form, with a surface of the original object;

curing the thermoplastic material to make the elastically deformable form;

detaching the elastically deformable form from the original object;

placing mortar or concrete into the elastically deformable form; and curing the mortar or concrete to obtain the high strength porous concrete structure, wherein a plurality of lumps whose surface configuration is similar to the surface configuration of the original object are interconnected and exposed to a surface of the high strength porous concrete structure and a gap is formed between said lumps through to a back side of the lumps, wherein the high strength porous concrete structure comprises a surface portion where the lumps are arranged within a certain thickness of the surface portion and a solid tightly filled backing portion and the lumps of the surface portion and the backing portion are integrally made of the same concrete.

3. A high strength porous concrete structure having a surface configuration corresponding to a surface configuration of an original object, manufactured by a method comprising the steps of:

contacting a heated-to-melt thermoplastic material, which cures to an elastically deformable form, with a surface of the original object;

curing the thermoplastic material to make the elastically deformable form;

detaching the elastically deformable form from the original object;

placing mortar or concrete into the elastically deformable form; and curing the mortar or concrete to obtain the high strength porous concrete structure, wherein a plurality of lumps whose surface is a configuration of rough aggregates are interconnected and exposed to a surface of the high strength porous concrete structure and a gap is formed between said lumps through to a back side of the lumps, wherein said lumps are arranged all over the thickness of the high strength porous concrete structure and are integrally formed of the same concrete.

4. A high strength porous concrete structure having a surface configuration corresponding to a surface configuration of an original object, manufactured by a method comprising the steps of:

contacting a heated-to-melt thermoplastic material, which cures to an elastically deformable form, with a surface of the original object;

curing the thermoplastic material to make the elastically deformable form;

detaching the elastically deformable form from the original object;

placing mortar or concrete into the elastically deformable form; and curing the mortar or concrete to obtain the high strength porous concrete structure, wherein a plurality of lumps whose configuration of the surface is a configuration of rough aggregates are interconnected and exposed to a surface of the high strength porous concrete structure and a gap is formed between said lumps through to a back side of the lumps, wherein the high strength porous concrete structure comprises a surface portion where the lumps are arranged within a certain thickness of the surface portion and a solid tightly filled backing portion and that the lumps of the surface portion and the backing portion are integrally made of the same concrete.

5. The high strength porous concrete structure as described in claim 1, wherein a plurality of continuous air bubbles are arranged in said concrete and part of the continuous air bubbles is open to the surface of the high strength porous concrete structure.

6. The high strength porous concrete structure as described in claim 4 wherein a plurality of continuous air bubbles are arranged in said concrete and part of the continuous air bubbles is open to the surface of the high strength porous concrete structure.

7. A high strength porous concrete structure having a surface configuration corresponding to a surface configuration of an original object, manufactured by a method comprising the steps of:

contacting a heated-to-melt thermoplastic material in a melted condition, which cures to an elastically deformable form, with a surface of the original object;

curing the thermoplastic material to make the elastically deformable form;

detaching the elastically deformable form from the object;

placing mortar or concrete into the elastically deformable form; and curing the mortar or concrete to form a surface layer and obtain the high strength porous concrete structure comprising a surface layer and a backing layer which has water permeability or a draining function and which is united with said surface layer, wherein said surface layer has an arrangement in which a plurality of lumps whose configuration is similar to a configuration of the original object and each of which is interconnected and exposed to a surface of the surface layer, that a gap is formed between said lumps through from the surface of said surface layer to a boundary between the surface layer and the backing layer, and that the lumps are integrally formed of the same concrete.

8. The high strength porous concrete structure as described in claim 7, wherein the backing layer is made of porous concrete using rough aggregates.

9. The high strength porous concrete structure as described in claim 7, wherein the backing layer is made of solid tight concrete and provided with a water through hole.

10. A high strength porous concrete structure having a surface configuration corresponding to a surface configuration of an original object, manufactured by a method comprising the steps of:

contacting a heated-to-melt thermoplastic material in a melted condition, which cures to an elastically deformable form, with a surface of the original object;

curing the thermoplastic material to make the elastically deformable form;

detaching the elastically deformable form from the object;

placing mortar or concrete into the elastically deformable form; and curing the mortar or concrete so as to form a surface layer and obtain the high strength porous concrete structure, comprising a surface layer and a backing layer which has water permeability or a draining function and which is united with said surface layer, wherein said surface layer has an arrangement in which a plurality of lumps which have a configuration of rough aggregates and each of which is interconnected and exposed to a surface of the surface layer, that a gap is formed between said lumps through from the surface of said surface layer to a boundary between the surface layer and the backing layer, and that the lumps are integrally formed of the same concrete.

11. The high strength porous concrete structure as described in claim 10, wherein the backing layer is made of porous concrete using rough aggregates.

12. The high strength porous concrete structure as described in claim 10, wherein the backing layer is made of solid tight concrete and provided with a water through hole.

* * * * *